US007404557B2

(12) United States Patent
Tada et al.

(10) Patent No.: US 7,404,557 B2
(45) Date of Patent: Jul. 29, 2008

(54) SHEET TRANSPORTING APPARATUS AND SHEET PROCESSING APPARATUS USING THE SAME

(75) Inventors: Michio Tada, Kanagawa (JP); Yoshimasa Sasaoka, Kanagawa (JP); Takashi Abe, Kanagawa (JP); Akira Iwasaka, Kanagawa (JP); Takuyoshi Kimura, Kanagawa (JP); Satoshi Shino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 10/657,130

(22) Filed: Sep. 9, 2003

(65) Prior Publication Data

US 2004/0188929 A1 Sep. 30, 2004

(30) Foreign Application Priority Data

Mar. 24, 2003 (JP) ..... P2003-081644

(51) Int. Cl.
*B65H 9/00* (2006.01)

(52) U.S. Cl. ..... 271/226; 271/241; 271/248

(58) Field of Classification Search ..... 271/226, 271/241, 251, 253, 254, 227, 248, 249, 250; 414/791.2

See application file for complete search history.

(56) References Cited

U.S. PATENT DOCUMENTS 2,190,418 A * 2/1940 Davidson ..... 271/251
4,192,495 A * 3/1980 Heinzelmann et al. ... 271/10.16
4,669,719 A * 6/1987 Fratangelo ..... 271/251
5,035,415 A * 7/1991 Lee et al. ..... 271/265.03
5,046,715 A * 9/1991 Taniguchi et al. ..... 271/164
5,094,442 A * 3/1992 Kamprath et al. ..... 271/227
5,219,159 A * 6/1993 Malachowski et al. ..... 271/228
6,488,275 B2 * 12/2002 Schlageter ..... 271/10.01
2001/0006273 A1 * 7/2001 Butterfass et al. ..... 271/227
2002/0074718 A1 * 6/2002 Schlageter ..... 271/227

FOREIGN PATENT DOCUMENTS

JP 60-262735 * 12/1985
JP 61-88934 6/1986
JP 63-258328 10/1988
JP 2-198952 * 8/1990
JP 4-7264 * 1/1992
JP A-7-206225 8/1995
JP A-2003-081490 3/2003

* cited by examiner

*Primary Examiner*—Patrick Mackey
*Assistant Examiner*—Thomas A Morrison
(74) *Attorney, Agent, or Firm*—Morgan, Lewis & Bockius LLP

(57) ABSTRACT

A sheet transporting apparatus, includes: a sheet transportation path; a predetermined number of transport members disposed in a sheet transportation path; a side position regulating mechanism which regulates a position of a side edge of a sheet in the sheet transportation path, the side position regulating mechanism having a reference member configured to change a sheet regulation position; a base member on which at least the reference member is mounted; a first adjusting mechanism which adjusts a position of the reference member; and a second adjusting mechanism which adjusts a position of a base member.

15 Claims, 21 Drawing Sheets

SHEET TRANSPORTING APPARATUS AND SHEET PROCESSING APPARATUS USING THE SAME

BACKGROUND OF THE INVENTION

1. Field of the Invention

The present invention relates to a sheet transporting apparatus disposed in a sheet transportation path. More particularly, the present invention relates to improvements of a sheet transporting apparatus in which, in a mode where the position of a side edge of a sheet is regulated, the sheet regulation position can be adjusted, and a sheet processing apparatus using such a transporting apparatus.

2. Background Art

A sheet processing apparatus such as a copier or a printer incorporates a sheet transporting apparatus which transports a sheet such as a paper sheet along a predetermined path. In a sheet transporting apparatus of this kind, a predetermined number of transportation rolls are arranged in a sheet transportation path. Each of the transportation rolls is rotatingly driven with using a motor or the like as a drive source. A sheet is transported from the upstream side to the downstream side in the transportation direction in accordance with the rotations of the transportation rolls.

In such a sheet transporting apparatus, when a sheet is transported in an inclined state, a so-called skew often occurs in the sheet. When a sheet in a skewed state is fed to a sheet processing section, a predetermined process is applied to the skewed sheet. When a skewed sheet is fed to an image output position of an image forming section, for example, an image which is inclined with respect to the sheet is output. Therefore, a sheet aligning apparatus for deskewing a transported sheet is usually used.

As one of aligning systems used in sheet aligning apparatuses, known is a system in which a skew is corrected by regulating the position of a side edge of a sheet. In the aligning system, a side guide is disposed on one side of a sheet transportation path along the transportation direction, and a skew roll is placed in the sheet transportation path. A transported sheet is laterally moved toward the side guide by the skew roll to butt against the side guide, thereby correcting the skew (side skew) of the sheet.

JP-A-7-206225 discloses an example of a sheet processing apparatus comprising such a sheet aligning apparatus. The apparatus has a configuration in which a sheet aligning apparatus is configured as one unit, the sheet aligning apparatus is extractably attached to the main unit of the sheet processing apparatus, and, under the attachment state, positioning is performed by butting a side guide of the sheet aligning apparatus against a stopper member of the main unit of the sheet processing apparatus.

In order to properly deskew a sheet in a sheet aligning apparatus, a reference line of a side guide must be placed strictly parallel to the sheet transportation direction, and a side edge of the sheet must extend along the reference line. When the reference line of the side guide is inclined with respect to the transportation direction, the sheet is transported with this inclination. As a result, the sheet is improperly deskewed.

By contrast, in the apparatus of JP-A-7-206225, since the sheet aligning apparatus is configured as one unit, the whole of the unit (sheet aligning apparatus) must be inclined in order to adjust the inclination of the reference line of the side guide. Therefore, the adjusting work is performed on a large scale and in a complicated manner, and fine adjustment is hardly conducted.

In order to eliminate the defects, the inventors of the invention provided a sheet transporting apparatus including: a sheet aligning section which has a reference member (such as a side guide) that is placed parallel to the transportation direction on one side of a sheet transportation path, and which causes a side edge of the sheet to elongate along a reference line set by the reference member; and an inclination adjusting section which has a rotation operating mechanism for rotatably supporting the reference member about a support shaft that is disposed in the transportation direction downstream from the sheet aligning section, and in which the inclination of the reference line with respect to the sheet transportation direction is adjusted by the rotation operating mechanism (see JP-A-2003-081490).

According to the configuration, the work of adjusting the inclination may be simplified as compared with the case where the whole unit is inclined, In the configuration, the inclination of the reference member is adjusted by the single adjusting mechanism (rotation operating mechanism). When the adjusting step of the adjusting mechanism is finely set, therefore, fine adjustment after an initialization has been once set can be performed in a relatively simple manner. In a case where, for example, a transportation roll serving as a peripheral part of the sheet aligning apparatus is replaced with another one, when the inclination angle of the reference member is to be reinitialized, the work of adjusting the inclination of the reference member requires a prolonged time period because of the fine adjustment step of the adjusting mechanism, and the workability remains to be poor.

In the configuration, before a job, the inclination adjustment of the reference member can be uniquely performed in accordance with the kind of the job, the sheet size, and the environment. In the case where the inclination adjustment of the reference member is to be performed in the middle of the job, however, it is often to hardly cope with such adjustment, particularly when the inclination of the reference member must be adjusted by a large degree.

In double-side printing, for example, the same sheet is continuously transported, and the sheet transportation face is changed from a first face to a second face. In this case, the front-rear relationship of the sheet is usually inverted, and hence it is often necessary to change the reference line of the reference member before the regulation of the side edge position of the sheet.

In this case, the line of the side edge position of the sheet is inverted. Therefore, the adjustment width of the inclination of the reference member is inevitably increased. Since the adjustment is performed during a job, the time period for the inclination adjustment is restricted. As a result, the inclination of the reference member is hardly adjusted during the process of inversion-transporting a sheet.

SUMMARY OF THE INVENTION

The invention has been conducted in order to solve the technical problems. It is an object of the invention to provide a sheet transporting apparatus in which a sheet regulation position can be adjusted easily and correctly by a side position regulating mechanism, and a sheet processing apparatus using such a transporting apparatus.

To achieve the object, the invention provides a sheet transporting apparatus, including: a sheet transportation path; a predetermined number of transport members disposed in a sheet transportation path; a side position regulating mechanism which regulates a position of a side edge of a sheet in the sheet transportation path, the side position regulating mechanism having a reference member configured to change a sheet regulation position; a base member on which at least the reference member is mounted; a first adjusting mechanism which adjusts a position of the reference member; and a second adjusting mechanism which adjusts a position of a base member.

The invention provides a sheet transporting apparatus which transports a sheet to a processing section via a sheet transportation path. The sheet transporting apparatus includes: a sheet aligning mechanism which aligns a transportation posture of the sheet transported toward the processing section; wherein the sheet aligning mechanism includes an adjusting mechanism which automatically adjusts the transportation posture of the sheet in accordance with a deformation degree of the sheet.

Further, the invention provides a sheet processing apparatus, including: a sheet transportation path; a sheet processing section disposed in a sheet transportation path; a predetermined number of transport members disposed in a sheet transportation path; a side position regulating mechanism which regulates a position of a side edge of a sheet in the sheet transportation path, the side position regulating mechanism having a reference member configured to change a sheet regulation position; a base member on which at least the reference member is mounted; a first adjusting mechanism which adjusts a position of the reference member; and a second adjusting mechanism which adjusts a position of a base member.

The invention provides a sheet processing apparatus, including: a sheet transportation path; a sheet processing section disposed in a sheet transportation path; and a sheet aligning mechanism which aligns a transportation posture of the sheet transported toward the processing section; wherein the sheet aligning mechanism includes an adjusting mechanism which automatically adjusts the transportation posture of the sheet in accordance with a deformation degree of the sheet.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
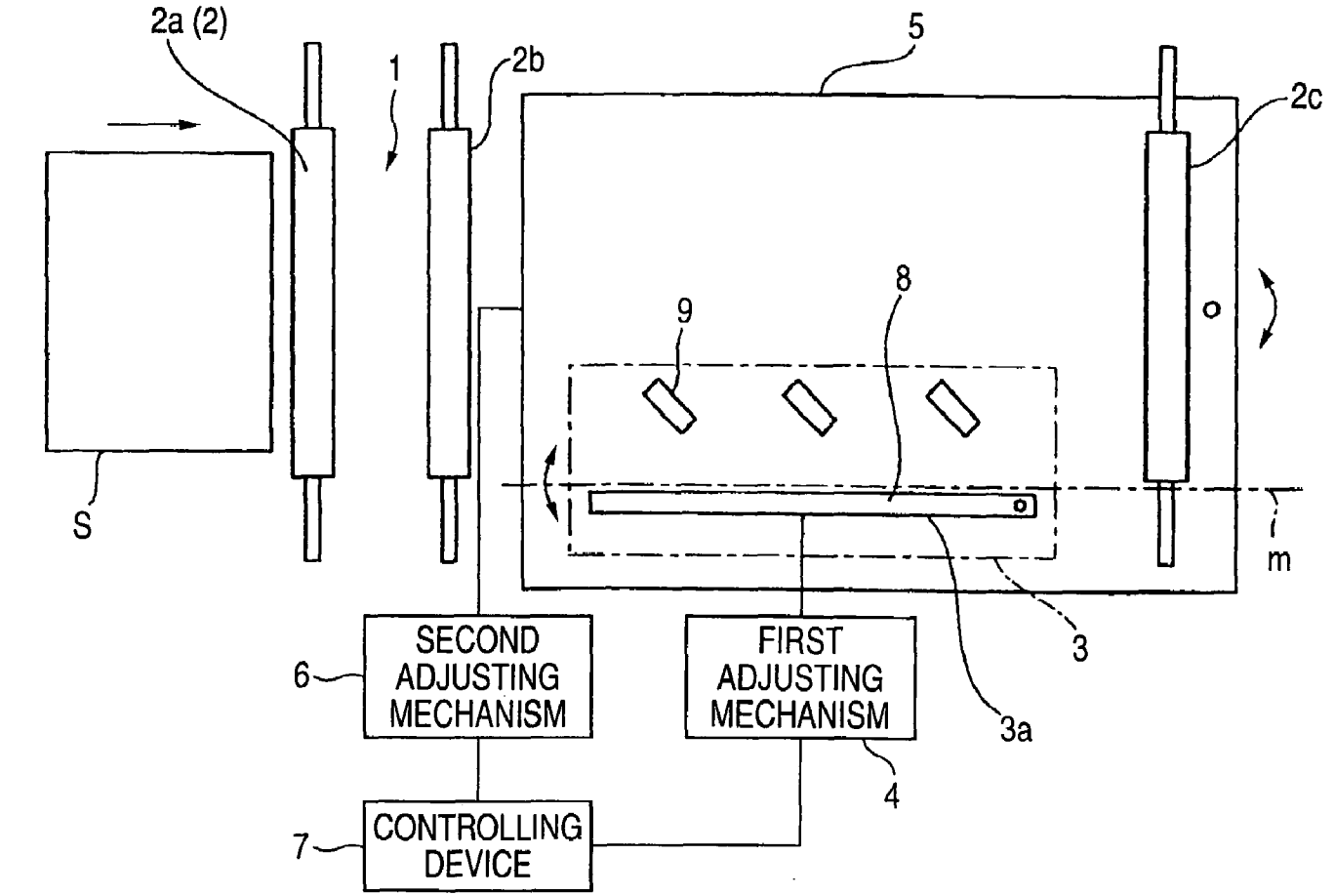
FIG. 1 is a diagram schematically showing the sheet transporting apparatus of the invention.

Hereinafter, the invention will be described in detail referring the accompanying drawings. The apparatus of the invention is a sheet transporting apparatus in which, as shown in FIG. 1, a predetermined number of transport members 2 (for example, 2*a* to 2*c*) are disposed in a sheet transportation path 1, wherein the apparatus includes; a side position regulating mechanism 3 which regulates a position of a side edge of a sheet S in the sheet transportation path 1; a first adjusting mechanism 4 which adjusts a position of a reference member 3*a* that can change a sheet regulation position m in the side position regulating mechanism 3; and a second adjusting mechanism 6 which adjusts a position of a base member 5 on which at least the reference member 3*a* of the side position regulating mechanism 3 is mounted.

In the technical means, the side position regulating mechanism 3 may be selected from a wide variety of mechanisms such as those of the side guide system and the sensor guide system.

In the side guide system, the side position regulating mechanism includes: a side guide 8 which is disposed on a side of the sheet transportation path 1 and correspondingly with the side edge position of the sheet S; and a skew member 9 which skew-transports the sheet S toward the side guide B. The skew member may have any one of configurations such as that the transportation direction of the sheet S is fixedly determined, and that the transportation direction is changed in accordance with the motion of the sheet S.

In the sensor guide system, the side position regulating mechanism comprises: at least two position sensors (not shown) which are disposed correspondingly with the side edge position of the sheet S; and a shift transportation roll (not shown) which nip-transports the sheets, and which is movable perpendicularly to a transportation direction of the sheet S.

The first adjusting mechanism 4 may be selected from a wide variety of mechanisms which can adjust the position of the reference member 3*a* of the side position regulating mechanism 3. The terms "reference member 3*a*" indicate a member which can change the sheet regulation position m, and mean the side guide 8 in the side guide system, or a sensor support member in the sensor guide system.

The second adjusting mechanism 6 may be selected from a wide variety of mechanisms which can adjust the position of the base member 5 on which the reference member 3*a* of the side position regulating mechanism 3 is mounted. In this case, it is not required to mount the whole of the side position regulating mechanism 3 on the base member 5, and at least the reference member 3*a* which is directly related to the sheet regulation position m is requested to be included.

The adjusting mechanisms 4, 6 may be adjusted by any kind of system. Preferably, a system which swings the mechanism around one swing fulcrum may be preferably employed.

The first adjusting mechanism 4 may support the reference member 3*a* that can change the sheet regulation position m in the side position regulating mechanism 3, in a manner that the reference member is swingable about a swing fulcrum with respect to the base member 5. The second adjusting mechanism 6 may support the base member 5 on which at least the reference member 3*a* of the side position regulating mechanism 3 is mounted, in a manner that the base member is swingable about a swing fulcrum.

The first adjusting mechanism 4 or the second adjusting mechanism 6 may operate in one of manual and automatic manners, or in both of manual and automatic manners.

As a typical configuration of the first adjusting mechanism 4 or the second adjusting mechanism 6 in which automatic adjustment is enabled, at least one of the first adjusting mechanism 4 and the second adjusting mechanism 6 may be configured so that a drive source is coupled to the reference member 3*a* or the base member 5 via a driving transmitting mechanism.

In a preferred configuration relating to the adjustment steps of the first adjusting mechanism 4 and the second adjusting mechanism 6, one of the first adjusting mechanism 4 and the second adjusting mechanism 6 can perform the adjustment by a coarse adjustment step, and the other adjusting mechanism can perform the adjustment by a fine adjustment step. According to the configuration, the coarse and fine adjustment steps allow the sheet regulation position m to be adjusted correctly and rapidly.

In the configuration, among the first adjusting mechanism 4 and the second adjusting mechanism 6, the mechanism of the fine adjustment step (for example, the first adjusting mechanism 4) operates with being linked with the mechanism of the coarse adjustment step (for example, the second adjusting mechanism 6). In this case, the adjusting mechanisms 4, 6 can function without interfering with each other.

In the configuration, preferably, the first adjusting mechanism 4 and the second adjusting mechanism 6 are combinedly used. However, it is not always required to combine the mechanisms. Of course, under a situation where the adjustment of the sheet regulation position m is very small, for example, only one of the mechanisms may be used.

The sheet transporting apparatus is regarded as a control system, the invention can be considered so as to comprise a controlling device 7 which controls the adjusting mechanisms 4, 6.

In a specific example of the control by the controlling device 7, in accordance with usage conditions of the sheet S, the controlling device adjusts at least one of the first and second adjusting mechanisms 4, 6. In the above, "usage conditions of the sheet S" include a wide variety of conditions of using the sheet S, such as the kind of the sheet, the size of the sheet, the environment, the conditions of processing the sheet S, and the direction of the transportation face of the sheet S. In a typical configuration in which the sheet regulation position m must be adjusted during a job, particularly, the usage conditions of the sheet S include the direction of the transportation face of the sheet S.

When a change of the transportation posture due to the deformation degree of the sheet (such as the degree of deformation caused in sheet cutting) is considered, the invention may be regarded as follows.

In this case, the apparatus of the invention is a sheet transporting apparatus which transports a sheet to a predetermined processing section via a sheet transportation path, wherein the apparatus includes a sheet aligning mechanism which aligns a transportation posture of the sheet transported toward the processing section, and the sheet aligning mechanism comprises an adjusting mechanism which automatically adjusts the transportation posture of the sheet in accordance with a deformation degree of the sheet.

In this configuration, when the sheet processing section is to apply a reprocess on a rear face of a sheet in which a front face has been processed, a typical example of the adjusting mechanism of the sheet aligning mechanism automatically adjusts the transportation posture of the sheet in accordance with the deformation degree of the sheet.

The apparatus may further includes a controlling device which controls the adjusting mechanism of the sheet aligning mechanism, and the sheet deformation degree may be previously supplied to the controlling device. Alternatively, the controlling device may comprise a measuring section which measures the sheet deformation degree.

The invention is not restricted to the sheet transporting apparatus, and may be directed to a sheet processing apparatus using such a sheet transporting apparatus. In this case, as shown in FIG. 1, the apparatus of the invention is a sheet processing apparatus having a sheet processing section (not shown) in the sheet transportation path 1, wherein the above-described sheet transporting apparatus is disposed in the sheet transportation path 1.

Next, embodiments of the invention will be explained.

Embodiment 1

Figure 2:
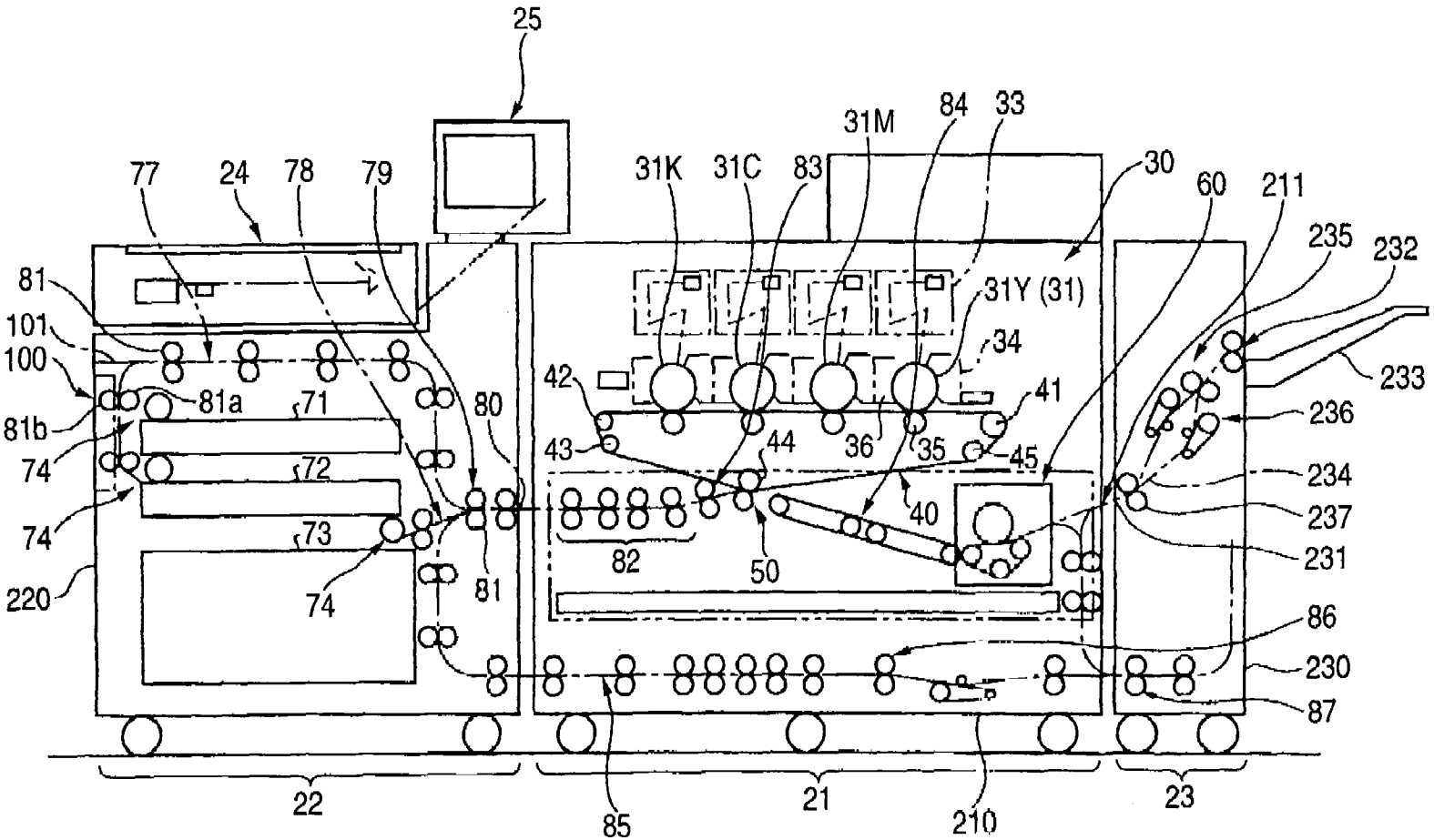
FIG. 2 is a diagram showing the whole configuration of an embodiment of a sheet processing apparatus into which the sheet transporting apparatus of the invention is incorporated.

FIG. 2 is a diagram showing Embodiment 1 of a sheet processing apparatus to which the invention is applied.

Referring to the figure, the sheet processing apparatus of the embodiment comprises: an image formation unit 21 incorporating an image forming module 30 which employs a so-called tandem intermediate transfer system; a sheet supply unit 22 which is juxtaposed with the image formation unit 21 to supply a sheet (not shown) such as a paper sheet to the image formation unit 21; and a postprocess unit 23 which is juxtaposed with the image formation unit 21 to apply a postprocess on a sheet that has been subjected to the image forming process by the image formation unit 21.

In the embodiment, the image formation unit 21 incorporates the image forming module 30 which forms toner images of color components (for example, yellow (Y), magenta (M), cyan (C), and black (K)) by, for example, the electrophotographic method. In the image forming module 30, photosensitive drums 31 (specifically, 31Y, 31M, 31C, and 31K) on which color component toner images are respectively formed and carried are arranged in parallel. The color component toner images formed on the photosensitive drums 31 are sequentially primary-transferred to an intermediate transfer belt 40. The color component toner images on the intermediate transfer belt 40 are secondary-transferred to a recording sheet supplied from the sheet supply unit 22 by a secondary transfer roll 50. The sheet is then guided to a fixing device 60.

In the embodiment, electrophotographic devices are sequentially arranged around each of the photosensitive drums 31. The electrophotographic devices include: a uniform charging device (not shown) which charges the photosensitive drum 31; a laser exposing device 33 which writes an electrostatic latent image on the photosensitive drum 31; a developing device 34 which houses a toner of the corresponding color component, and which develops the electrostatic latent image on the photosensitive drum 31; a primary transfer roll 35 which transfers the color component toner image on the photosensitive drum 31 to the intermediate transfer belt 40; and a cleaner 36 which removes away residual toner on the photosensitive drum 31.

The intermediate transfer belt 40 is circularly transported while being stretched by a plurality (in this example, five) of stretch rolls 41 to 45. For example, the stretch roll 41 is configured as a driving roll, and the other stretch rolls 42 to 45 are configured as driven rolls. One of the stretch rolls 42 to 45, e.g., the stretch roll 43 functions as a tension roll for applying tension to the intermediate transfer belt 40.

In the embodiment, a portion of the intermediate transfer belt 40 opposed to the stretch roll 44 is set as a secondary transfer position. The secondary transfer roll 50 is disposed in contact with the surface of the intermediate transfer belt 40 at the secondary transfer position. A transfer bias is applied between the secondary transfer roll 50 and the stretch roll 44 (functioning as a backup roll) which is opposed to the secondary transfer roll.

In the embodiment, as shown in FIG. 2, the sheet supply unit 22 has multiple (in the example, three) sheet supply trays 71 to 73. The sheet supply trays 71, 72 house plain paper sheets of different sizes, and the lowermost large-capacity sheet supply tray 73 houses special sheets including stiff sheets such as coated paper or cardboard.

In the embodiment, each of the sheet supply trays 71, 72 has a feeder 74 on the side opposite to the image formation unit 21, and the sheet supply tray 73 has a feeder 74 on the side of the image formation unit 21.

A sheet transportation path from the sheet supply trays 71, 72 is configured as a bypass transportation path 77 which is upward directed from the side of the sheet supply unit 22 opposite to the image formation unit 21, directed toward the image formation unit 21 with using the upper space, and then downward directed.

By contrast, a sheet transportation path from the sheet supply tray 73 is configured as a direct transportation path 78 which elongates in a substantially linear manner toward the image formation unit 21. The direct transportation path 78 and the bypass transportation path 77 are communicatingly joined to a combined transportation path 79 so that a recording sheet is fed through an exit 80 toward the image formation unit 21.

Plural paired transportation rolls 81 are disposed at predetermined intervals in the bypass transportation path 77, the direct transportation path 78, and the combined transportation path 79 of the sheet supply unit 22.

In a unit case 220 of the sheet supply unit 22, a cover 100 which opens and closes the bypass transportation path 77 is disposed in a portion opposite to the image formation unit 21.

The cover 100 swings with using an inner side of the unit case 220 as a swing fulcrum, and rotatably holds one of paired transportation rolls 81 (81*a*, 81*b*), or the driven roll 81*b*. When the cover is opened, the driving roll 81*a* and the driven roll 81*b* of the transportation rolls 81 are separated from each other.

In the embodiment, in a horizontal transportation path portion of the bypass transportation path 77 of the sheet supply unit 22, a coupling transportation path 101 is formed so as to horizontally elongate toward the side opposite to the image formation unit 21. The coupling transportation path 101 functions as a transportation path which, in the case where another sheet supply unit (not shown) is placed adjacent to the sheet supply unit 22, receives a recording sheet supplied from the other sheet supply unit to guide the sheet to the bypass transportation path 77, or as an insertion portion for manually feeding a recording sheet to the sheet supply unit 22.

In the embodiment, an image reading unit 24 and a user operating unit 25 are disposed above the sheet supply unit 22.

The image reading unit 24 optical reads an image of a document placed on a document table, and is configured by a light source, a reflection mirror, an imaging lens, a CCD sensor, etc.

In the embodiment, as shown in FIG. 2, the postprocess unit 23 has an entrance opening 231 at a position of a unit case 230 corresponding to a recording sheet discharge port 211 which is opened in a unit case 210 of the image formation unit 21. An exit opening 232 is opened at a position of the unit case 230 in the side opposite to the image formation unit 21.

In this example, the entrance opening 231 is disposed at a predetermined position of a lower portion (which is lower in level than one half of the height of the postprocess unit 23) of the postprocess unit 23, the exit opening 232 is disposed at a predetermined position of an upper portion (which is higher in level than one half of the height of the postprocess unit 23) of the postprocess unit 23, and a sheet discharge tray 233 is attached to the unit case 230 corresponding to the exit opening 232.

An inclined transportation path 234 which is obliquely directed is disposed between the entrance opening 231 and the exit opening 232. The inclined transportation path 234 branches to two paths. The branch transportation paths are provided with decurling devices 235, 236 for eliminating upcurls and downcurls, respectively.

An adequate number (in this example, three) of paired transportation rolls 237 are disposed in the inclined transportation path 234.

The sheet transportation paths in the image formation unit 21 includes a path which reverses a sheet fed out from the fixing device 60, and which returns the reversed sheet to the secondary transfer position, in addition to a path along which a sheet supplied from the sheet supply unit 22 is guided to the secondary transfer position and then passed through the fixing device 60 to be discharged toward the postprocess unit 23.

Figure 3:
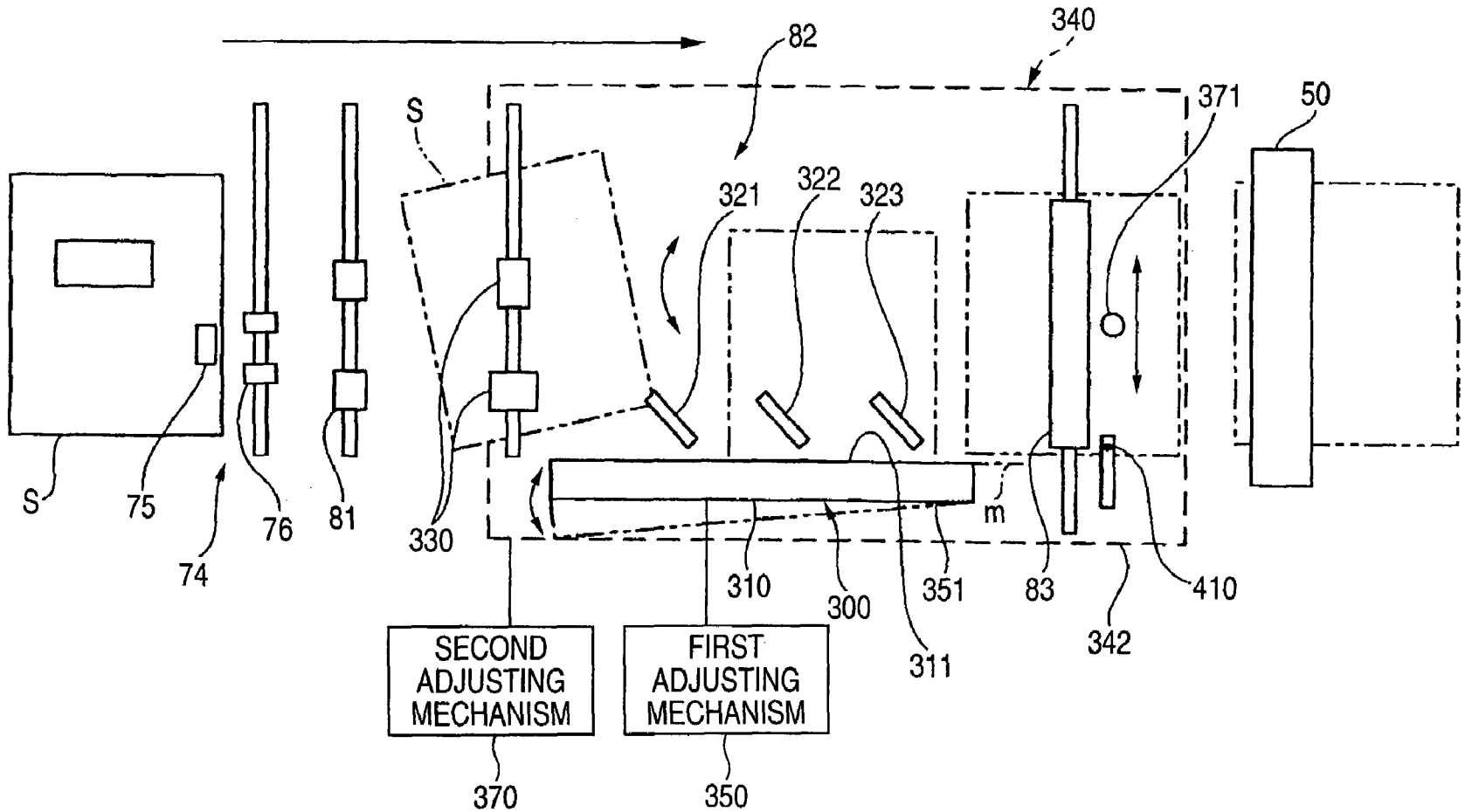
FIG. 3 is a plan view showing main portions of the sheet transporting apparatus used in the embodiment.

In the sheet transporting apparatus of the embodiment, as shown in FIGS. 2 and 3, a sheet aligning device 82 is disposed upstream from the secondary transfer position, a registration roll 83 is disposed between the sheet aligning device 82 and the secondary transfer position, and a transportation belt 84 is disposed downstream from the secondary transfer position.

In FIG. 3, 74 denotes a feeder which is disposed in each of the sheet supply trays 71 to 73, and, for example, comprises a nudger roll 75 which pushes the sheets S, and a feed roll 76 which separates the pushed sheets S and then feeds the separated sheet. The reference numeral 81 denotes a typical one of transportation rolls (takeaway rolls), and 410 denotes a side shift sensor which is disposed immediately downstream from the registration roll 83 to detect a shift amount of the registration roll 83.

A sheet returning mechanism used in the embodiment is used for transferring the sheet S fed from the fixing device 60 to an adequate number of transportation rolls 86 along a loop-like return path 85. In the mechanism, a reversing portion (in this example, configured by using a lower space of the postprocess unit 23) 87 is disposed in the middle of the return path 85, and the sheet S is reversed through the reversing portion 87.

A part of the return path 85 is communicatingly joined to the combined transportation path 79 with using a space in the sheet supply unit 22.

The sheet aligning device 82 used in the embodiment will be described in detail.

The sheet aligning device 82 comprises a side position regulating mechanism 300 which regulates the position of a side edge of the sheet S in the sheet transportation path.

In the embodiment, the side position regulating mechanism 300 comprises a side guide 310 which is disposed on the side of the sheet transportation path, and a plurality (in this example, three) of skew rolls 321 to 323 disposed in the sheet transportation path.

The side guide 310 corresponds to the reference member in the invention. A reference face 311 of the side guide 310 is used for setting a sheet regulation position (reference line) m serving as a reference line for deskewing the sheet S.

Each of the skew rolls 321 to 323 is arranged with being inclined to the side guide 310 with respect to the transportation direction of the sheet S, and configured by a driving roll and a pinch roll (driven roll) which pressingly contact each other. The driving roll is inclinedly placed as illustrated. By contrast, the pinch roll is placed along the sheet transportation direction without being inclined. The driving roll and the pinch roll are placed so as to vertically sandwich the sheet transportation path.

In the embodiment, the sheet aligning device 82 comprises entrance swing rolls 330 upstream from the skew rolls 321 to 323 in the sheet transportation path.

The entrance swing rolls 330 are configured by paired driving rolls and pinch rolls, and arranged along the transportation direction of the sheet S. Unlike the other transportation rolls, at least the driving rolls are configured as split rolls of different diameters and on the same shaft, so that the received sheet S is transported with being slightly skewed in the direction opposite to the side guide 310, thereby preventing interference between the sheet S and the side guide 310 from occurring.

In the embodiment, particularly, the sheet aligning device 82 and the registration roll 83 are incorporated in one transportation unit 340.

Figure 6:
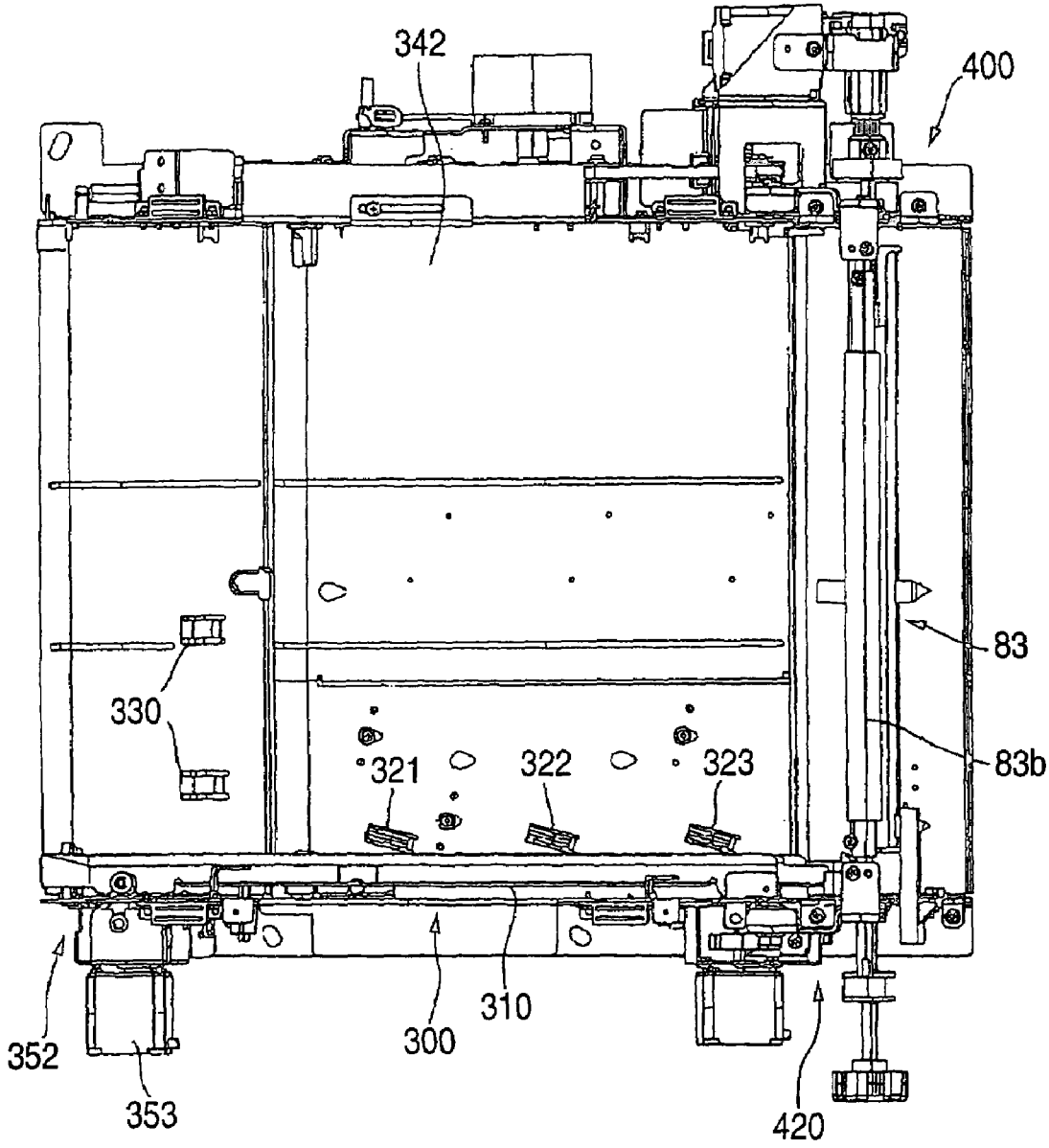
FIG. 6 is a plan view showing a state where an upper cover is removed away from the transportation unit of FIG. 4.

In the transportation unit 340, as shown in FIGS. 3 to 6, a unit case 341 is configured by putting a unit cover 343 on a unit base 342, and the sheet aligning device 82 (the side position regulating mechanism 300 [the side guide 310, the skew rolls 321 to 323], and the entrance swing rolls 330) and the registration roll 83 are mounted on the unit base 342 (FIG. 6 shows a state where the unit cover 343 is detached from the unit case 341).

A first adjusting mechanism 350 for adjusting the position of the side guide 310 is disposed in the transportation unit 340.

Figure 7:
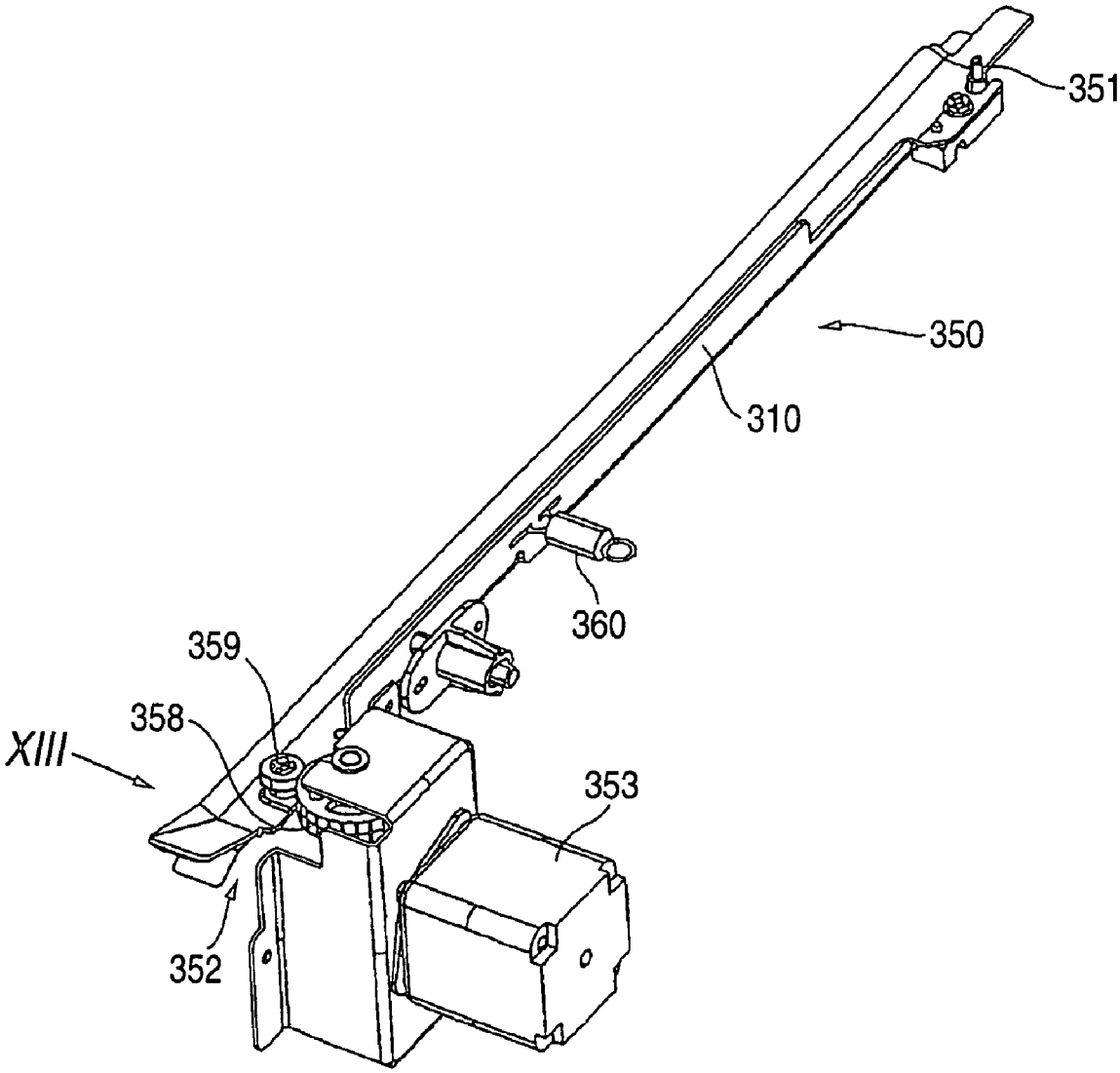
FIG. 7 is a view showing a first adjusting mechanism used in the embodiment.
Figure 8:
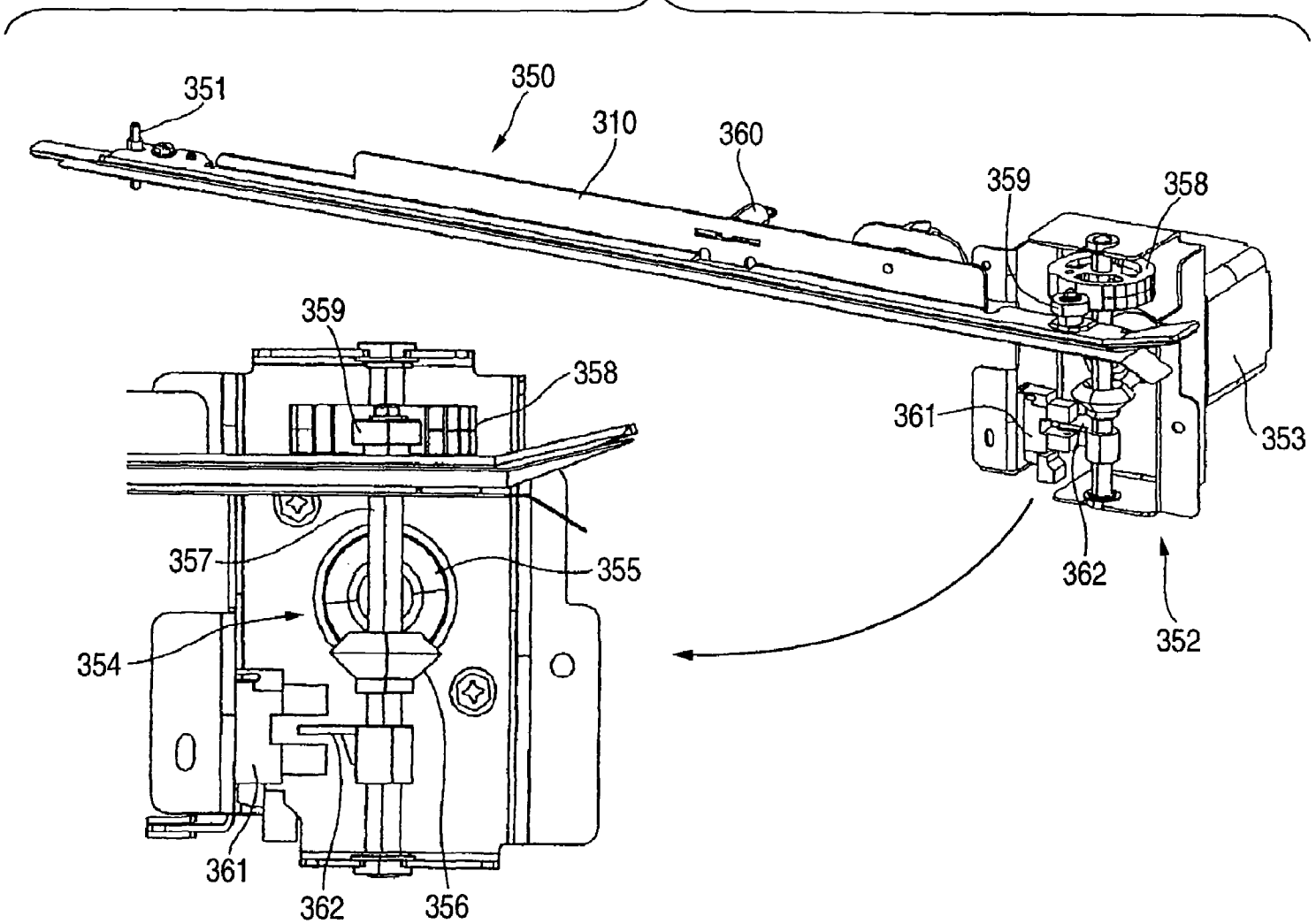
FIG. 8 is a view looking in the direction of VIII in FIG. 7.
Figure 9:
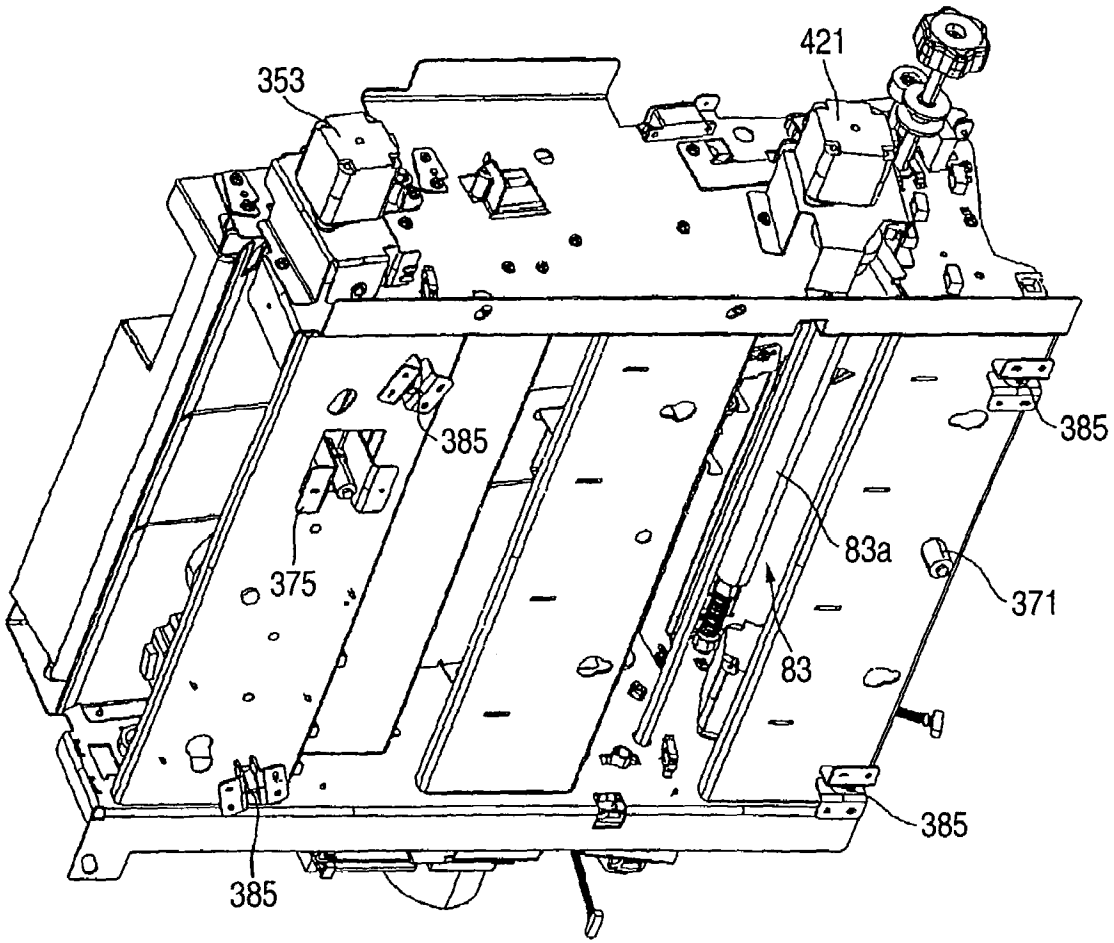
FIG. 9 is a perspective view looking the transportation unit of FIG. 4 from the rear side.
Figure 10:
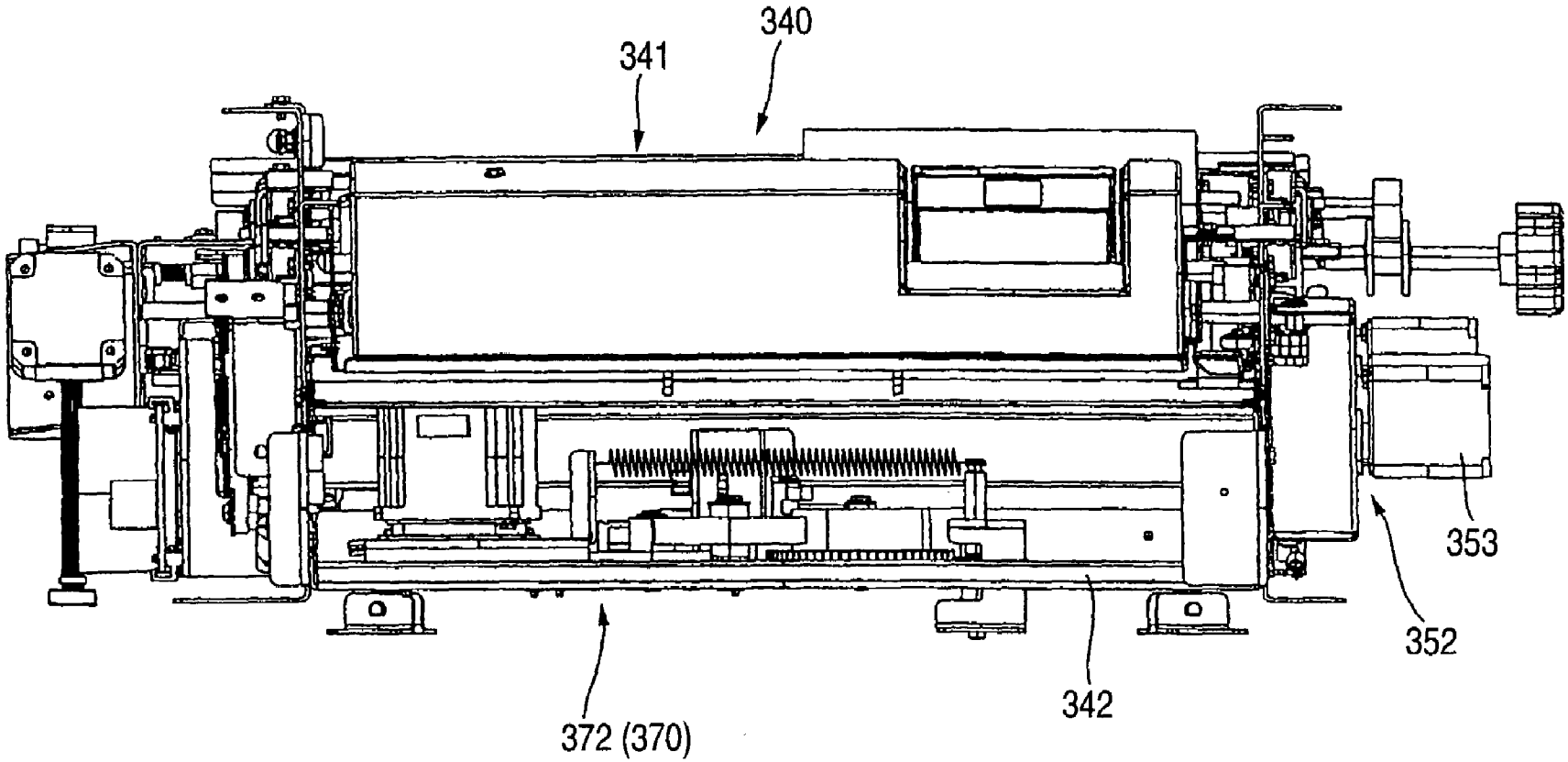
FIG. 10 is a view looking in the direction of X in FIG. 4.
Figure 11:
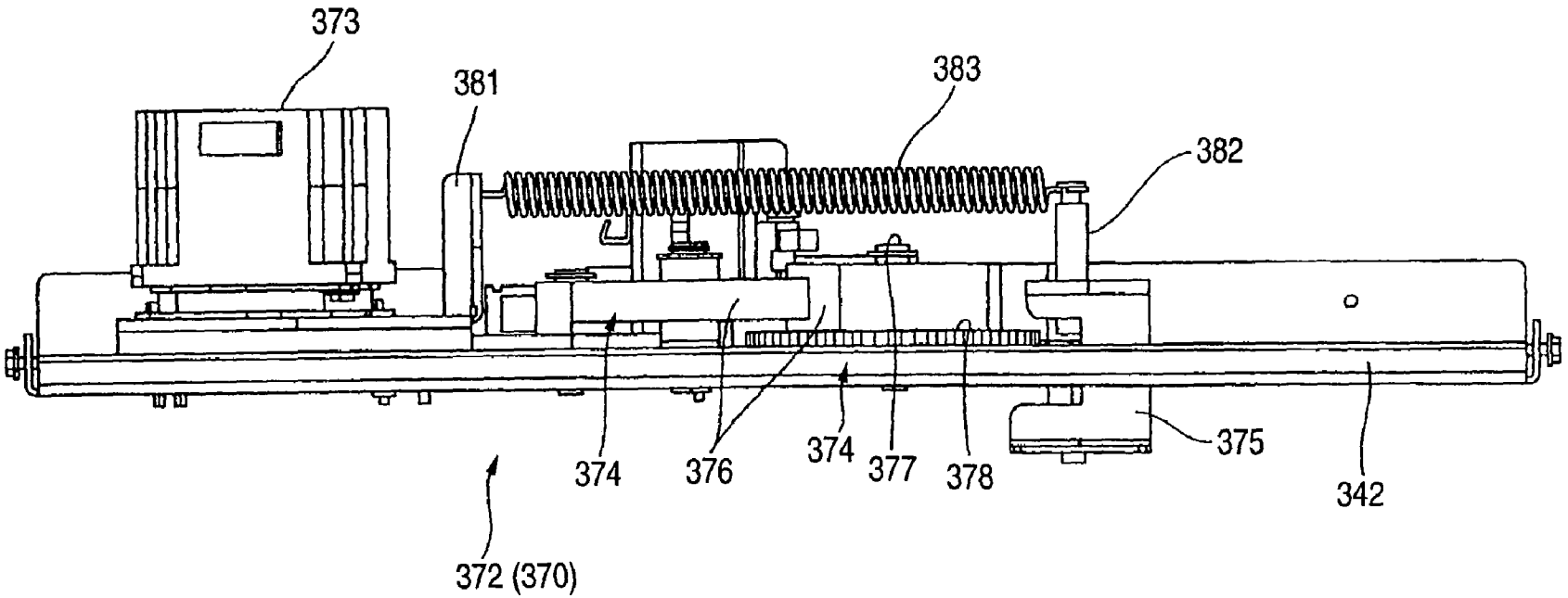
FIG. 11 is a view showing a driving system of a second adjusting mechanism used in the embodiment.

As shown in FIGS. 6 to 8, a downstream end in the sheet transportation direction of the side guide 310 is supported as a swing fulcrum (pivot) 351 on the unit base 342, and a swing operating mechanism 352 is disposed in the vicinity of the other end of the side guide 310. In the swing operating mechanism 352, a guide motor 353 serving as a drive source is fixed to the unit base 342, and the driving force of the guide motor 353 is transmitted to the other end of the side guide 310 through a drive transmission system 354.

The drive transmission system 354 may be configured in the following manner. The driving force of the guide motor 353 is transmitted through a train of bevel gears 355, 356 to a drive transmission shaft 357 which is perpendicular to the shaft of the guide motor 353. An eccentric cam 358 is secured to the drive transmission shaft 357. A cam follower 359 which butts against the eccentric cam 358 is rotatably attached to the other end of the side guide 310 corresponding to the eccentric cam 358. An urging spring 360 is attached to a position of the side guide 310 which is separated from the swing fulcrum 351 of the side guide 310. The eccentric cam 358 and the cam follower 359 are placed so as to pressingly contact each other.

In the embodiment, for example, the guide motor 353 is configured by a step motor, and rotatingly driven in a predetermined range by driving pulses, so that the swing free end portion of the side guide 310 is swung by a degree corresponding to the eccentric distance due to the rotation of the eccentric cam 358. In the embodiment, particularly, the guide motor 353 is set so as to have a fine unit rotation angle for each driving pulse. In FIG. 8, 361 denotes a home sensor for detecting the initial position of the side guide 310. When the position of a light shielding plate 362 protruded from the drive transmission shaft 357, the initial position of the side guide 310 is detected.

In the embodiment, a second adjusting mechanism 370 for adjusting the position of the unit base 342 is disposed in the transportation unit 340.

In the second adjusting mechanism 370, as shown in FIGS. 3 and 9 to 13, a substantially middle portion of a downstream side in the sheet transportation direction of the bottom of the unit base 342 is swingably supported as a swing fulcrum (pivot) 371 on a frame which is not shown. A swing operating mechanism 372 is disposed in the side opposite to the swing fulcrum 371 of the unit base 342. A predetermined number (in this example, four) of guide rollers 385 are disposed on the bottom of the unit base 342. The guide rollers 385 are placed so as to be swingable about the swing fulcrum 371.

In the swing operating mechanism 372, a unit motor 373 serving as a drive source is fixed to the unit base 342, and a drive transmission system 374 is interposed between the unit motor 373 and a fixation bracket 375 which is fixed to the frame (not shown).

The drive transmission system 374 is configured in the following manner. The driving force of the unit motor 373 is transmitted through a train 376 of several gears to a final drive transmission shaft 377. An eccentric cam 378 is secured to the final drive transmission shaft 377. A cam follower 380 is rotatably disposed correspondingly with the eccentric cam 378 on a support pin 379 which upstands from the fixation bracket 375. An urging spring 383 is interposed between an engagement plate 381 fixed to the unit base 342, and an engagement pin 382 fixedly formed on the fixation bracket 375, thereby causing the eccentric cam 378 and the cam follower 380 to pressingly contact each other.

Figure 12:
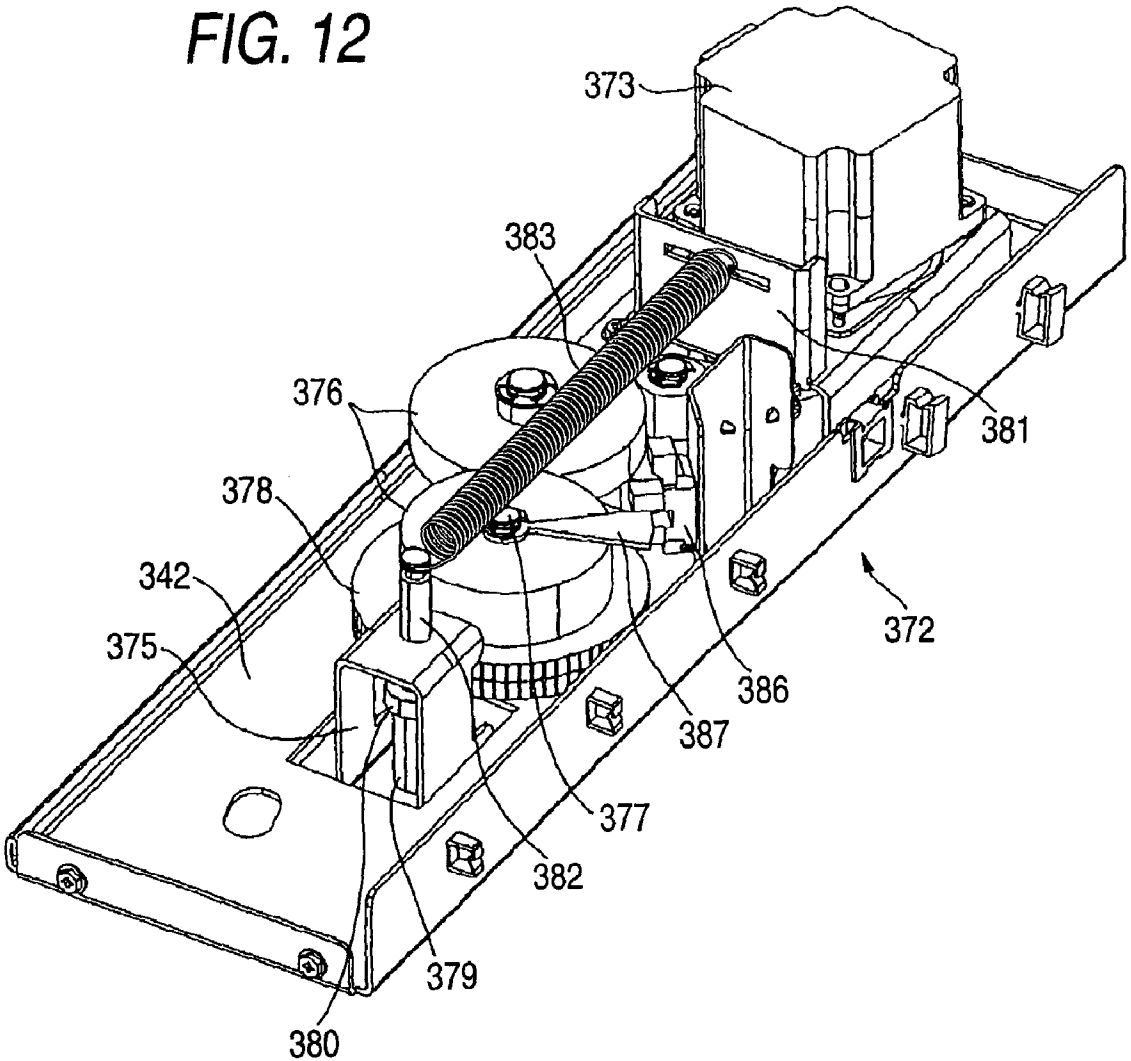
FIG. 12 is a perspective view of the driving system of FIG. 11.
Figure 13:
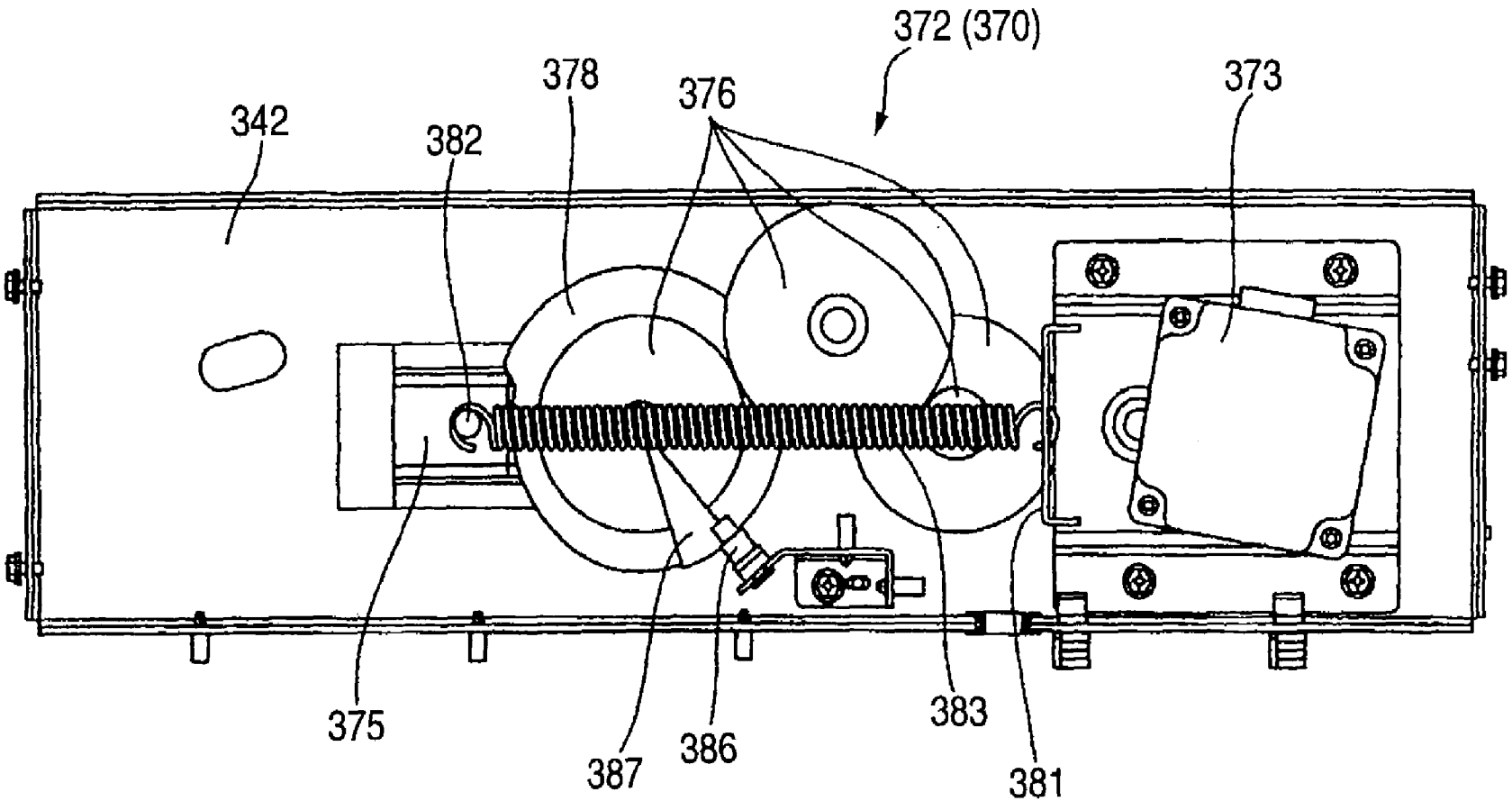
FIG. 13 is a plan view of the driving system of FIG. 12.

In the embodiment, for example, the unit motor 373 is configured by a step motor, and rotatingly driven in a predetermined range by driving pulses, so that the swing free end portion of the unit base 342 is swung by a degree corresponding to the eccentric distance due to the rotation of the eccentric cam 378. In the embodiment, particularly, the unit rotation angle of the unit motor 373 for each driving pulse is set to be larger than that of the guide motor 353. In FIGS. 12 and 13, 386 denotes a home sensor for detecting the initial position of the unit base 342. When the position of a fan-shaped light shielding plate 387 protruded from the final drive transmission shaft 377, the initial position of the unit base 342 is detected.

Figure 4:
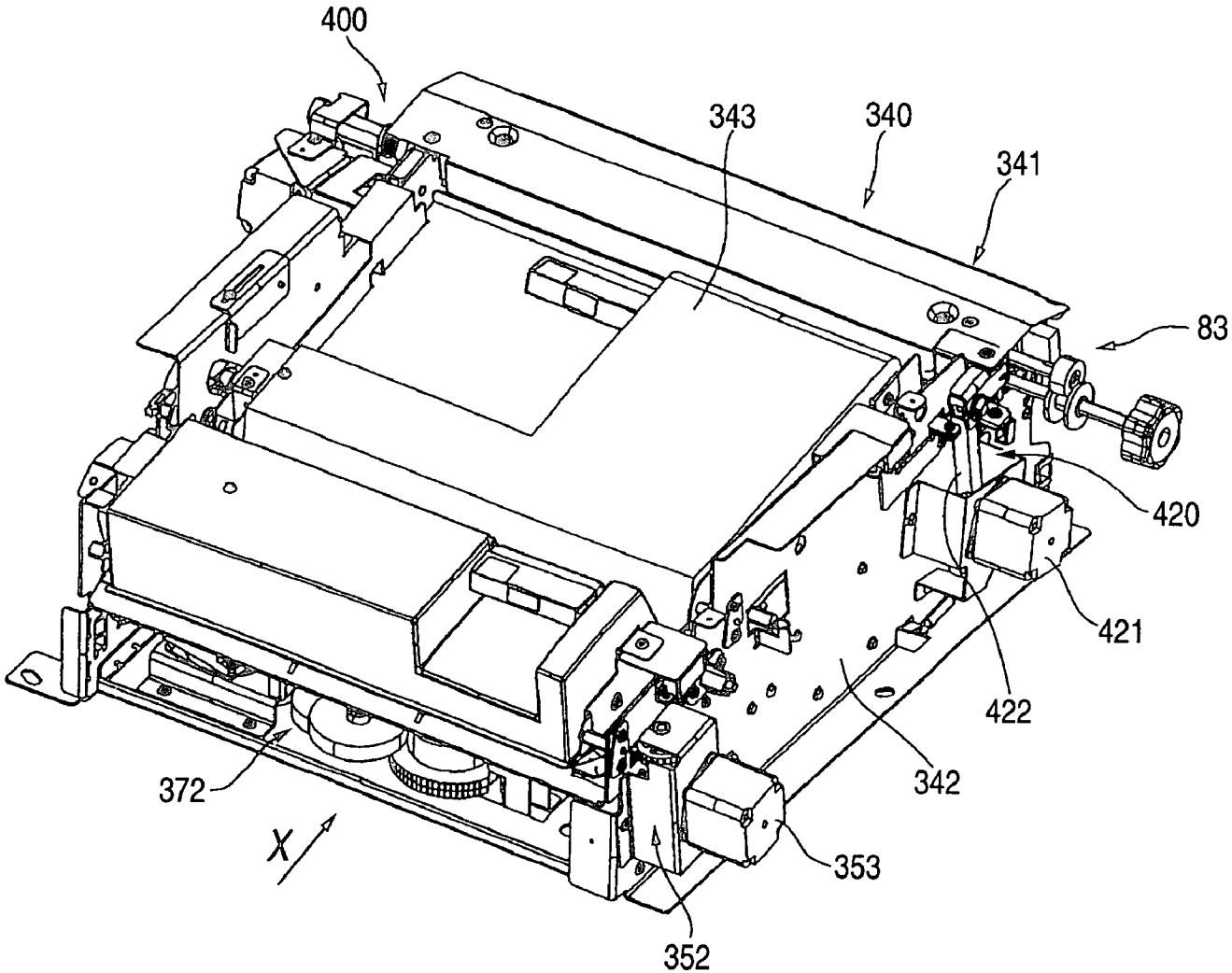
FIG. 4 is a perspective view showing a transportation unit used in the embodiment.
Figure 5:
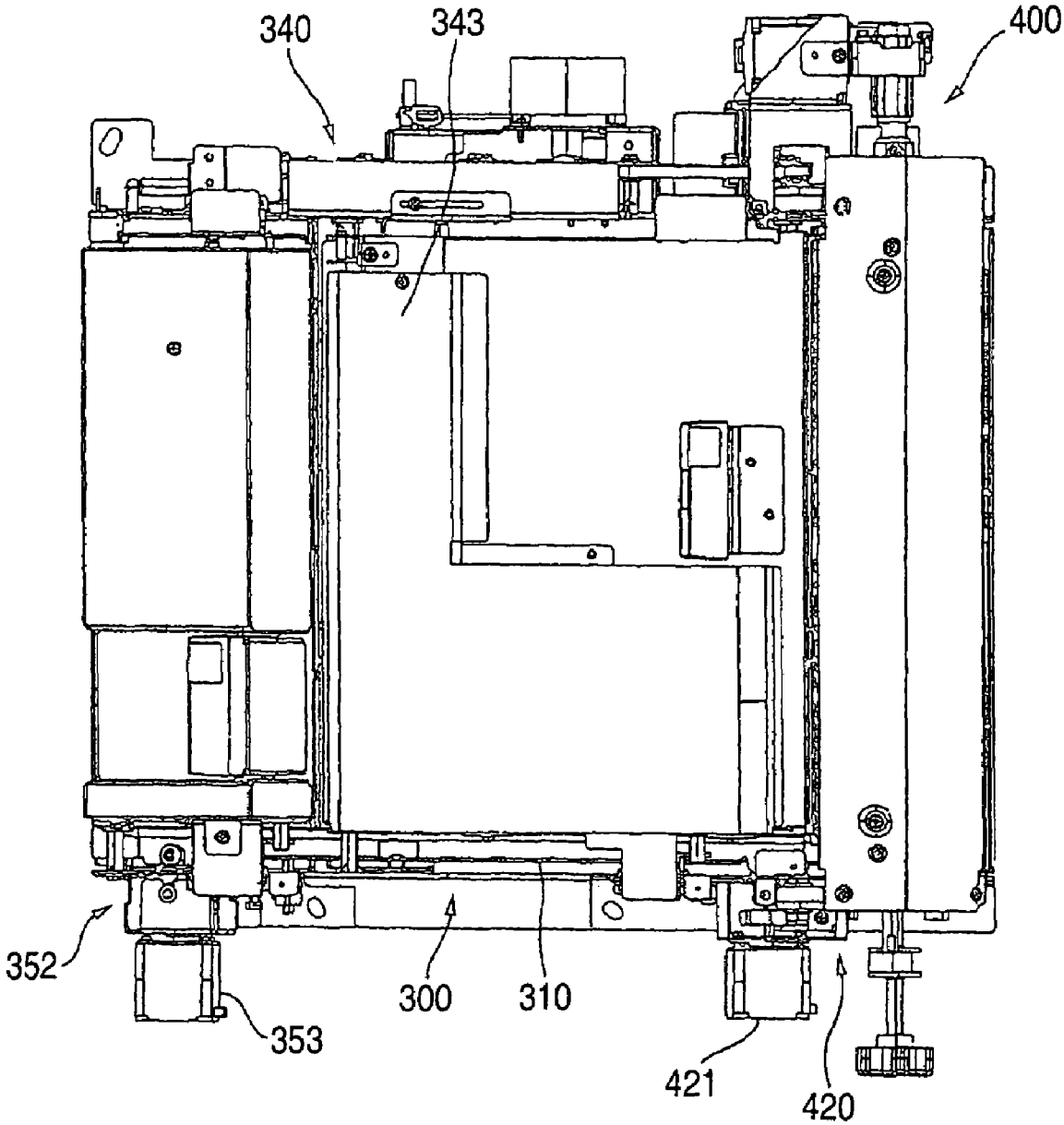
FIG. 5 is a plan view of the transportation unit of FIG. 4.
Figure 14:
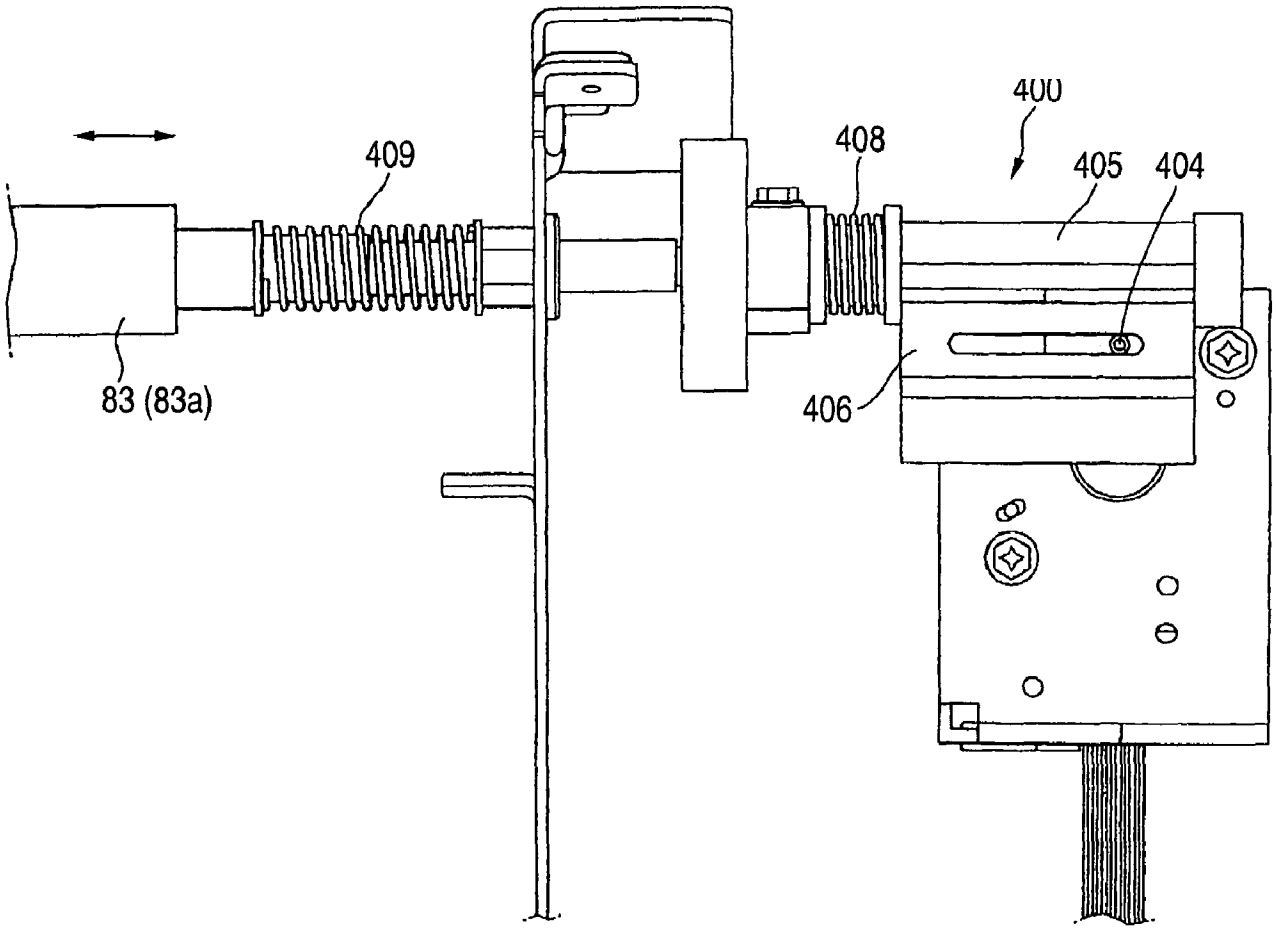
FIG. 14 is a diagram showing a side shifting mechanism for a registration roll.
Figure 15:
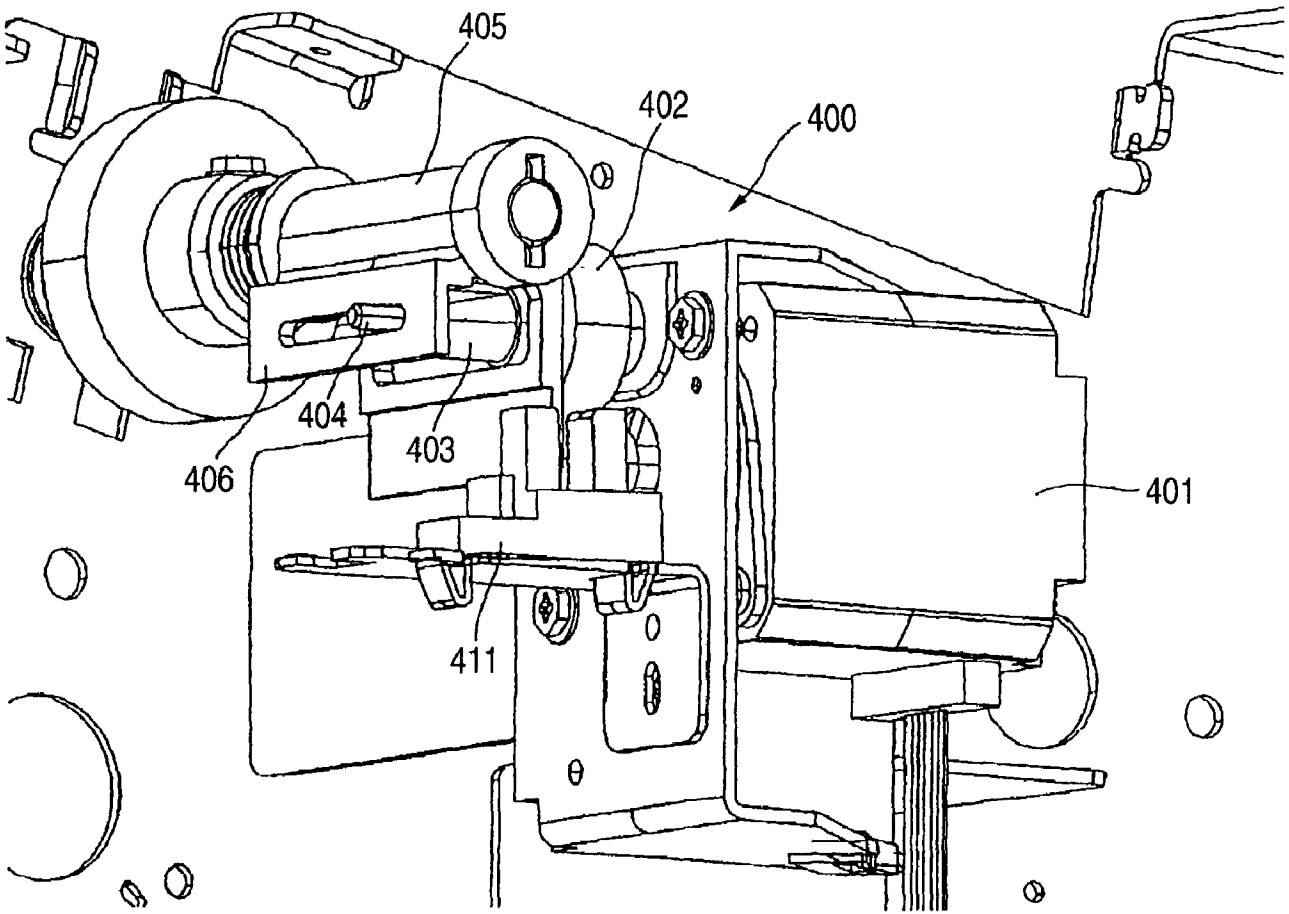
FIG. 15 is a perspective view of the side shifting mechanism.

In the embodiment, as shown in FIGS. 4, 14, and 15, the registration roll 83 is supported so as to be laterally shiftable by a side shifting mechanism 400.

In the side shifting mechanism 400, the driving force of a shift motor 401 is reduction-transmitted to a drive transmission shaft 403 via a reduction gear train 402, and a pinion 404 is disposed on the drive transmission shaft 403. A shift rod 405 is coupled to an end portion of the registration roll 83 (in this example, a drive roll 83*a*) in a state where the registration roll 83 is allowed to rotate. A rack 406 is formed on the shift rod 405. The pinion 404 is meshed with the rack 406.

The reference numeral 408 denotes an urging spring which presses the shift rod 405, and 409 denotes an urging spring which prevents rattling from occurring during an operation of shifting the registration roll 83. The reference numeral 411 denotes a side shift home sensor which detects the home position of the registration roll 83.

In the embodiment, the registration roll 83 is caused to perform nipping and releasing operations by a nipping/releasing mechanism 420.

The nipping/releasing mechanism 420 transmits a driving force of a lift-up motor 421 through an eccentric cam (not shown) and a link arm 422 to cause a pinch roll 83*b* (see FIG. 6) of the registration roll 83 to perform nipping and releasing operations.

A nipping/releasing mechanism (not shown) which is similar to that in this example is disposed for each of the skew rolls 321 to 323 (see FIG. 3) so that nipping and releasing operations are performed at adequate timings.

Figure 16:
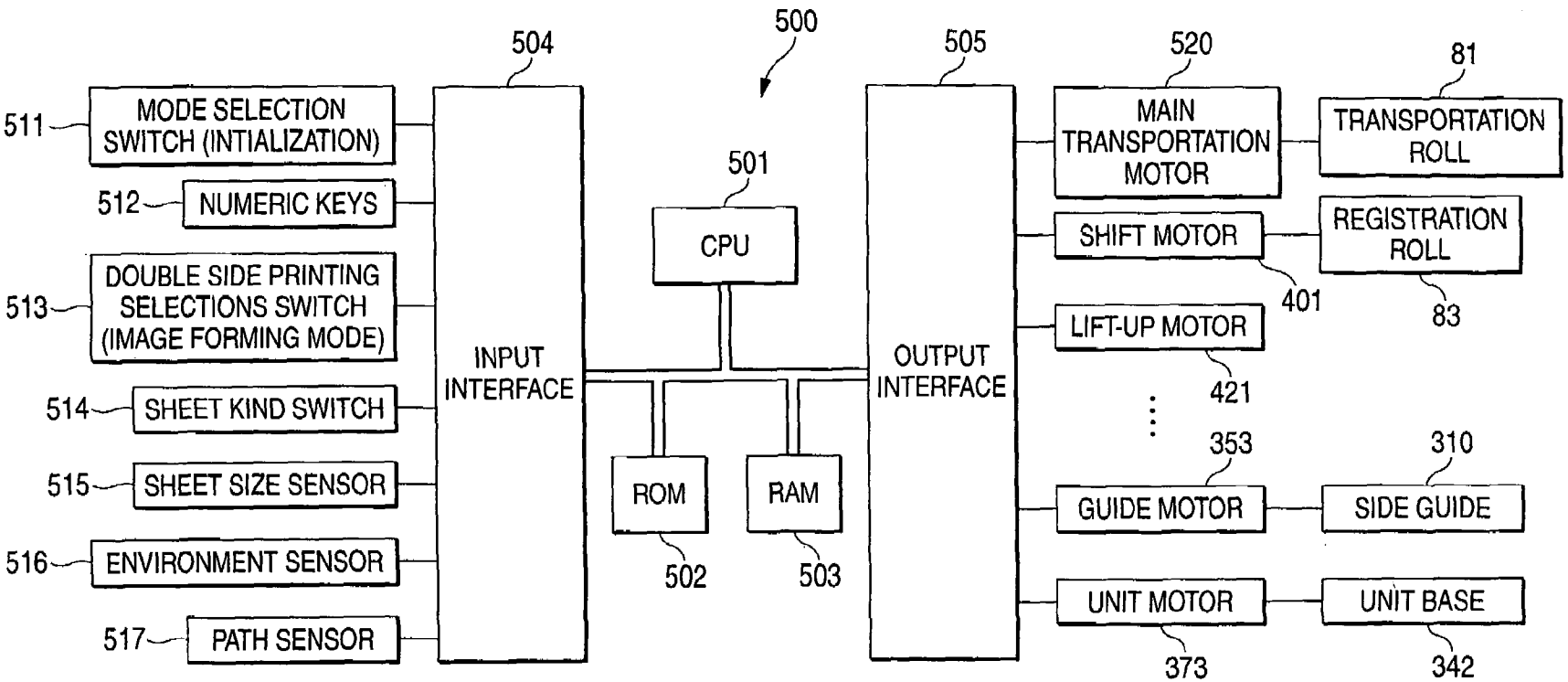
FIG. 16 is a block diagram showing a control system used in the embodiment.

In the embodiment, as shown in FIG. 16, a controlling device 500 is configured by a microcomputer system (a CPU 501, a ROM 502, a RAM 503, and input and output interfaces 504, 505). The ROM 502 previously stores an image forming program, a sheet transportation program (including a sheet regulation position control program), etc.

In the controlling device 500, the CPU 501 receives via the input interface 504 signals from: various mode selection switches (including a selection switch for initialization) 511, and numeric keys 512; a switch 513 for selecting double side printing which is one of image forming modes; a sheet kind switch 514 for selecting sheets of various basis weights, an OHP sheet, and the like; sheet size sensors 515 which are disposed in the sheet supply trays 71 to 73 (see FIG. 2) and the sheet transportation paths; environment sensors 516 of the humidity, the temperature, and the like; and path sensors 517 (including the side shift sensor 410 (see FIG. 3)) which detect the sheet passing state. The CPU 501 executes a predetermined process program to send predetermined control signals to a main transportation motor 520, the shift motor 401, the lift-up motor 421, the guide motor 353, the unit motor 373, and the like through the output interface 505, thereby controlling the corresponding control objects (such as the transportation rolls 81, the registration roll 83, the side guide 310, and the unit base 342).

Next, the operation of the image forming apparatus of the embodiment will be described (while focusing on the sheet transporting apparatus).

As shown in FIG. 2, assuming that a sheet is fed from one of the sheet supply trays 71 and 72 of the sheet supply unit 22, the sheet is fed from the exit 80 toward the image formation unit 21 through the bypass transportation path 77 and the combined transportation path 79, and then transported to the secondary transfer position through the sheet aligning device 82 and the registration roll 83.

Under this state, a color toner image formed by the image forming module 30 is transferred to the sheet, and the sheet which has undergone the transfer process is passed through the fixing device 60 and then transported toward the postprocess unit 23.

In the postprocess unit 23, the sheet is transported through the inclined transportation path 234. During this process, under the condition that the sheet is curled, a postprocess (decurling) is performed in one of the decurling devices 235, 236, and the sheet is then discharged onto the sheet discharge tray 233.

A recording sheet fed from the sheet supply tray 73 is a special sheet such as coated paper or cardboard. Since the sheet is fed from the exit 80 toward the image formation unit 21 through the direct transportation path 78 and the combined transportation path 79, the sheet can be transported to the secondary transfer position without particularly causing bending deformation or jamming.

Figure 17:
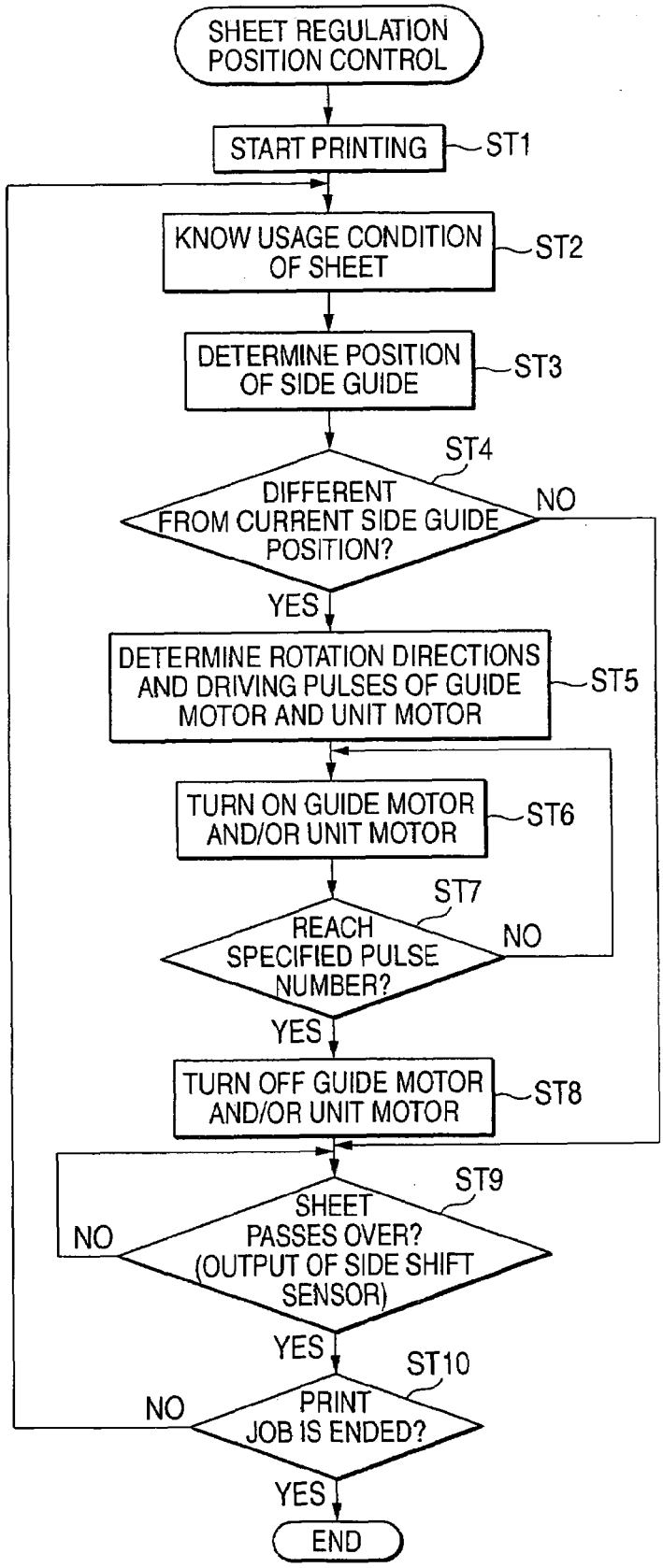
FIG. 17 is a flowchart showing a process of controlling a sheet regulation position used in the embodiment.

In such an operation process, the process of transporting the sheet S to the secondary transfer position is performed as shown in FIGS. 17 and 18.

Referring to FIG. 17, when a print start button is depressed, the controlling device 500 receives signals from various switches and sensors such as the mode selection switches 511, and knows the usage conditions of the sheet S (ST1, ST2). Thereafter, the position of the side guide corresponding to the usage conditions of the sheet S is determined by, for example, searching table information which is previously set in accordance with the usage conditions of the sheet S (ST3). It is judged whether the determined side guide position is different from the currently set side guide position or not (ST4).

If it is judged that the determined side guide position is different from the current one, the controlling device 500 determines the rotation directions and driving pulses of the guide motor 353 and the unit motor 373 (ST5).

At this time, the controlling device 500 determines whether both or one of the guide motor 353 and the unit motor 373 is driven, in accordance with the adjustment amount of the side guide 310.

As a result, the guide motor 353 and/or the unit motor 373 is turned on, and, at a timing when the pulse number reaches the specified one, turned off (ST6 to ST8).

Figure 18A:
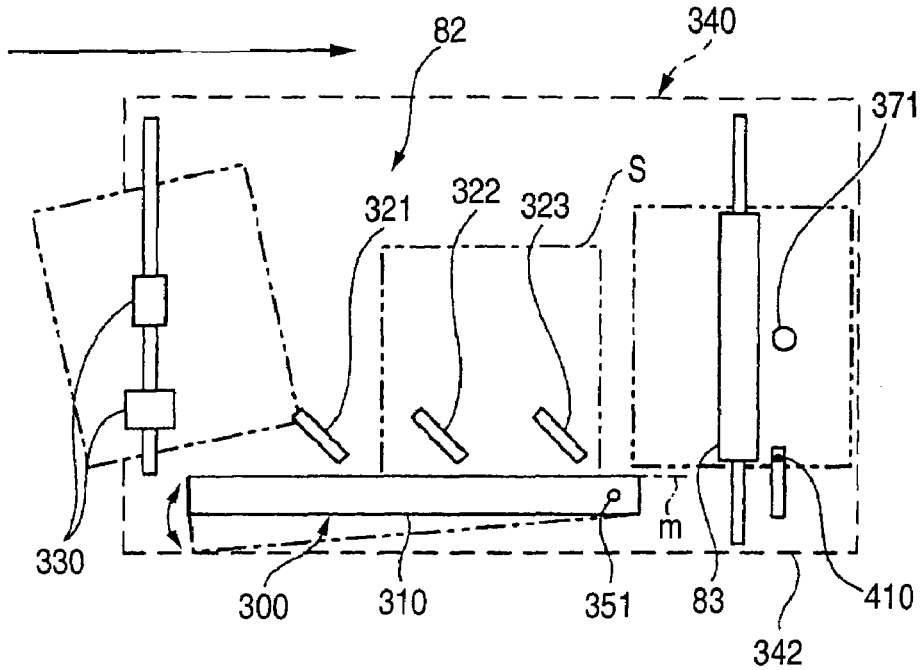
FIGS. 18A and 18B are diagrams showing processes of adjusting the sheet regulation position in the embodiment.

In this state, when only the guide motor 353 is to be driven, for example, the side guide 310 is adjusted by the first adjusting mechanism 350 driven by the guide motor 353 as shown in FIG. 18A, to be swung about the swing fulcrum 351 from the position of the broken line to that of the solid line, so that the sheet regulation position m of the side guide 310 is determined.

Figure 18B:
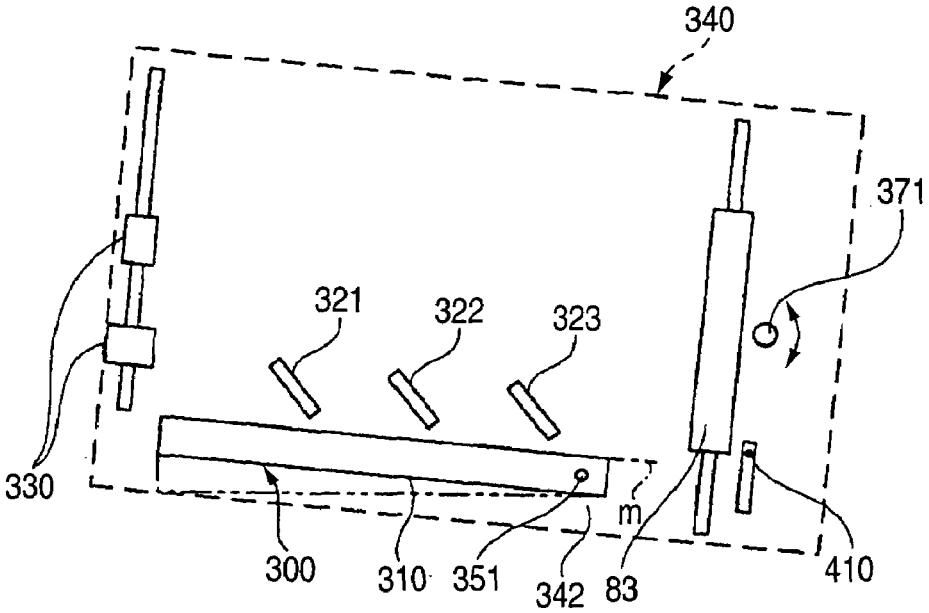

By contrast, when both the guide motor 353 and the unit motor 373 are to be driven, for example, the side guide 310 is adjusted by the first adjusting mechanism 350 driven by the guide motor 353 as shown in FIG. 18B, to be swung about the swing fulcrum 351 from the position of the broken line to that of the solid line, and further adjusted by the second adjusting mechanism 370 driven by the unit motor 373, so that the unit base 342 on which the side guide 310 is mounted is swung about the swing fulcrum 371. The sheet regulation position m of the side guide 310 is finally determined by the motions of the side guide and the unit base.

In this case, the first adjusting mechanism 350 can perform fine adjustment, and the second adjusting mechanism 370 can perform coarse adjustment. Even when the adjustment amount of the position of the side guide 310 is considerably large, therefore, the adjustment can be performed correctly and rapidly by combinedly using both the mechanisms.

When the sheet S thereafter passes over the side shift sensor 410 (see FIG. 3), the processes of ST2 to ST10 are repeated until the print job is ended.

If it is judged in ST4 that the side guide position determined by the controlling device 500 is identical with the current one, it is not necessary to change the position of the side guide 310, and hence the control skips to ST9.

Figure 19A:
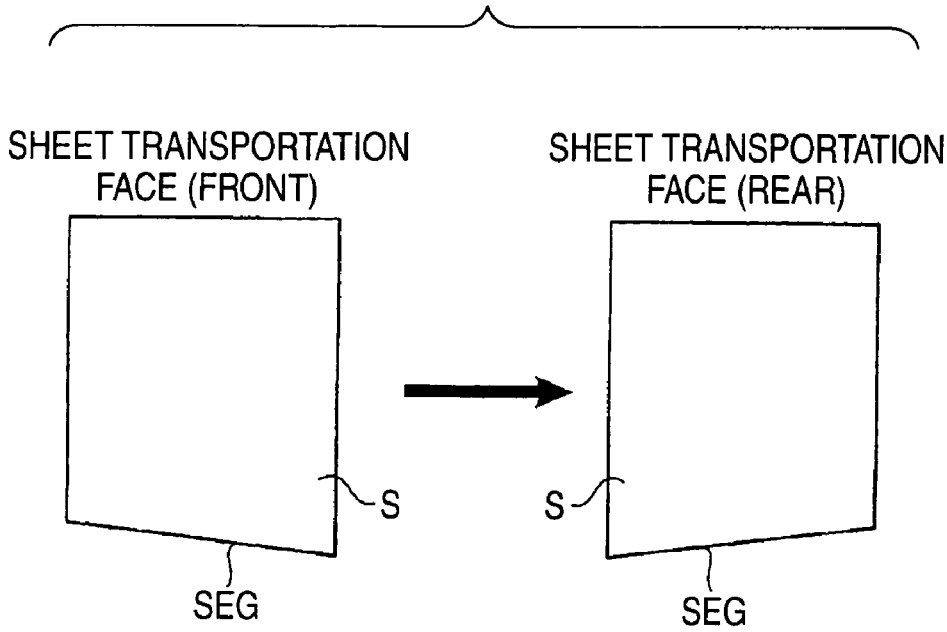
FIG. 19A is a diagram showing a state of transporting a sheet in double-side printing.

The case where a double side printing mode is implemented by the double side printing selection switch 513 is assumed as the usage conditions of the sheet S. During printing on one face, as shown in FIG. 19A, the sheet S is transported while upward directing the sheet transportation face. It is assumed that, at this time, the reference edge Seg of the sheet S is caused by, for example, a cutting error of the sheet to be inclined as shown in the figure.

When printing is to be performed on the rear face of the sheet S, the sheet S in which printing has been performed on the front face is reversed, and hence the front-rear relationship of the sheet S is inverted, so that the sheet S is transported while downward directing the sheet transportation face. At this time, the reference edge Seg of the sheet S is inclined as illustrated, but the direction of the inclination is opposite to that in the printing on the front face.

When an aligning operation is performed on the sheet S while not changing the sheet regulation position m of the side guide 310 under this state, there is the possibility that the sheet transportation by means of the rear face of the sheet S is performed while being skewed.

Figure 19B:
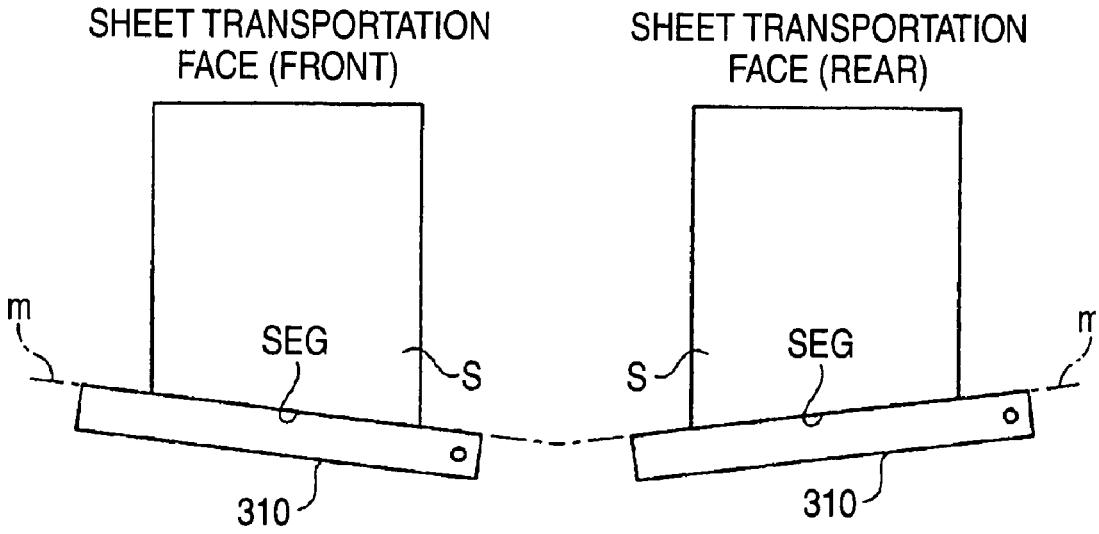
FIG. 19B is a diagram showing a process of adjusting the sheet regulation position in double-side printing.

In the embodiment, therefore, the direction of the transportation face of the sheet S is considered, and a system is employed in which, as shown in FIG. 19B, the sheet regulation position m of the side guide 310 is changed in accordance with the front and rear faces of the sheet S.

When this system is employed, the sheet aligning mechanism configured by the side position regulating mechanism 300, the first adjusting mechanism 350, and the second adjusting mechanism 370 performs adjustment of the position of the side guide 310 depending on the front and rear faces of the sheet S to align the transportation posture of the sheet. Therefore, the reduction of the image quality due to a skew of the sheet S can be effectively avoided.

In this case, deformation degrees of the sheet S depending on the front and rear faces of the sheet S may be previously stored into the memory (the RAM 503) of the controlling device 500 shown in FIG. 16. Alternatively, a device for measuring the deformation degree of a sheet (such as a sheet edge detector using a line sensor) is disposed in the sheet transportation path, and the deformation degree of the sheet S may be measured in each transportation.

It is a matter of course that the adjustment of the transportation posture of a sheet in accordance with the deformation degree of the sheet can be applied also to a configuration in which one of the adjusting mechanisms 350 and 370 is disposed in the side position regulating mechanism 300.

In the embodiment, as shown in FIGS. 2 and 3, after the side position of the sheet S is regulated by the sheet aligning device 82, the sheet is nipped and laterally shifted by a predetermined amount by the registration roll 83, and then fed to the transfer section.

This is performed in order to prevent a damage due to a contact between the side guide 310 and the sheet S from occurring.

At this time, the shifting, and nipping and releasing operations of the registration roll 83 are controlled in the following manner.

Referring to FIGS. 3 and 16, when the tip end of the sheet S is transported to the registration roll 83 to reach the side shift sensor 410 in the downstream of the registration roll 83, the controlling device 500 controls the shift motor 401 so as to forward rotate, there by starting the shifting operation of the registration roll 83.

At a timing before the sheet S is nipped by the registration roll 83 and the registration roll 83 starts the shifting operation, the nipping operations of the skew rolls 321 to 323 are canceled.

The sheet S nipped by the registration roll 83 is moved in accordance with the shifting operation of the registration roll 83, and the side shift sensor 410 is turned off. Then, the controlling device 500 stops the shift motor 401 after elapse of a timer time T1.

Thereafter, the sheet S is transported to the secondary transfer position. After elapse of a timer time T2, the controlling device 500 drives the lift-up motor 421 to lift the pinch roll 83*b* (see FIG. 6) of the registration roll 83, thereby canceling the nipping operation of the registration roll 83.

After an elapse of a timer time T3 from the cancellation of the nipping operation of the registration roll 83, the controlling device 500 controls the shift motor 401 so as to reversely rotate, the side shift home sensor 411 is turned off, and the shift motor 401 is stopped after an elapse of a timer time T4.

By contrast, when the controlling device 500 detects that the sheet S passes over the registration roll 83 (for example, the side shift sensor 410 detects the rear end of the sheet S), the controlling device drives the lift-up motor 421 to cause the registration roll 83 to perform the nipping operation, so that the sheet transporting apparatus is prepared for the next sheet.

In the embodiment, when the sheet regulation position of the side guide 310 is to be initialized, as shown in FIG. 16, the mode selection switch 511 corresponding to selection of an initializing setting mode is operated, and the amount of initialization by the first adjusting mechanism 350, and that of initialization by the second adjusting mechanism 370 are then set with using the numeric keys 512, etc.

In the embodiment, the system in which both the first and second adjusting mechanisms 350 and 370 can be automatically operable is structured. Alternatively, at least one of the adjusting mechanisms may be configured so as to be manually operable (for example, an operation knob may be disposed in place of the motor serving as a drive source).

For example, the first adjusting mechanism 350 is set to be automatically operable, and the second adjusting mechanism 370 is set to be manually operable. In the process of initialization or maintenance, also the second adjusting mechanism 370 is used in addition to the first adjusting mechanism 350, and, in a usual job, only the first adjusting mechanism 350 is used.

Embodiment 2

Figure 20:
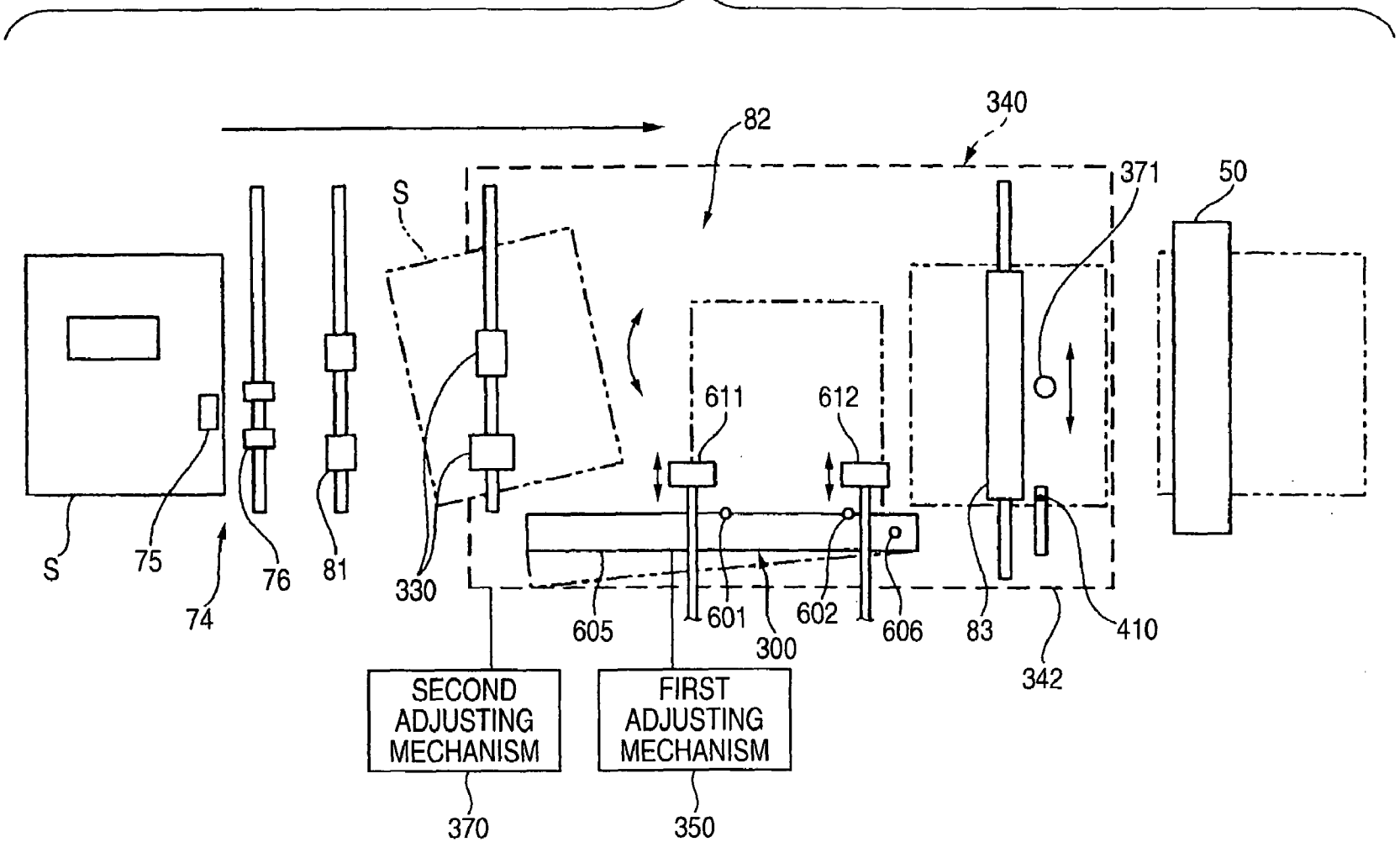
FIG. 20 is a plan view showing main portions of a sheet transporting apparatus used in an embodiment of the invention.

FIG. 20 is a diagram showing main portions of a sheet transporting apparatus of Embodiment 2.

Referring to the figure, the basic configuration of the sheet transporting apparatus has a sheet aligning device 82 which aligns the side edge position of the sheet S in a substantially same manner as Embodiment 1. However, the side position regulating mechanism 300 of the sheet aligning device 82 is different from that of Embodiment 1. The components identical with those of Embodiment 1 are denoted by the same reference numerals, and their detailed description is omitted.

Figure 21:
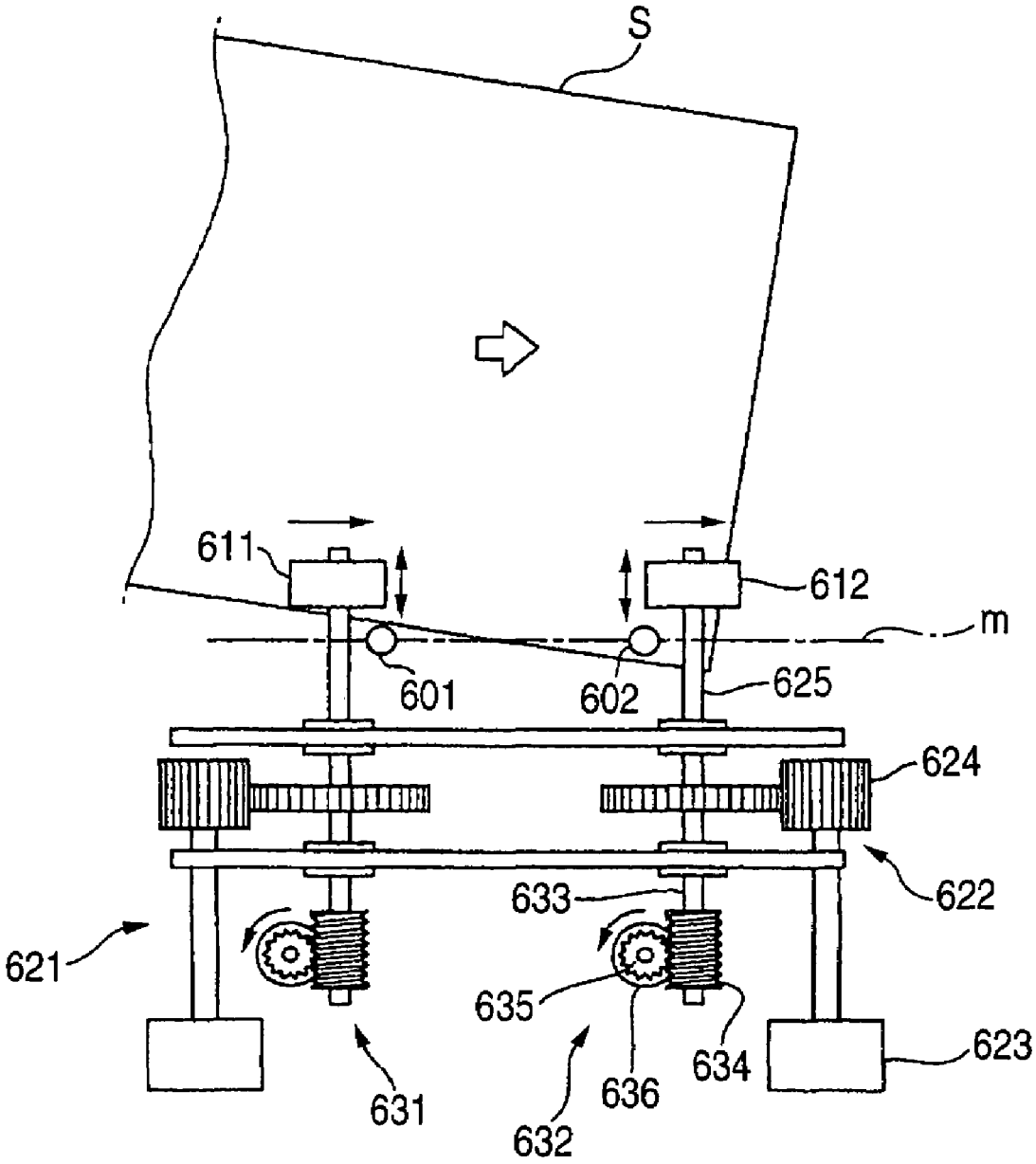
FIG. 21 is a view showing a side position regulating mechanism used in the embodiment.

In the embodiment, as shown in FIGS. 20 and 21, the side position regulating mechanism 300 comprises: two position sensors 601, 602 which are disposed on a side of the sheet transportation path and on a reference line corresponding to the sheet regulation position m; and shift transportation rolls 611, 612 which nip-transport the sheet S, and which are movable perpendicularly to the sheet transportation direction.

The position sensors 601, 602 are attached onto a sensor support member 605 corresponding to the reference member in the invention. The first adjusting mechanism 350 is disposed on the sensor support member 605. The first adjusting mechanism 350 performs a swing operation with using a downstream end portion in the sheet transportation direction of the sensor support member 605 as a swing fulcrum (pivot)

606, and can be configured in a substantially same manner as that of Embodiment 1. The second adjusting mechanism 370 performs a swing operation with using a downstream end portion in the sheet transportation direction of the unit base 342 as the swing fulcrum 371, and is configured in a substantially same manner as that of Embodiment 1.

The adjusting mechanisms 350, 370 are controlled by a controlling device which is substantially similar to that of Embodiment 1.

The shift transportation rolls 611, 612 are supported by rotation driving mechanisms 621, 622 and side shifting mechanisms 631, 632, respectively.

Each of the rotation driving mechanism 621, 622 is configured so that a driving force of a drive motor 623 is transmitted to a shaft 625 of a shift transportation roll 611 or 612 through a transmission gear train 624.

Each of the side shifting mechanisms 631, 632 is configured in the following manner. A shift rod 633 is coupled to an end portion of the shift transportation roll 611 or 612. A rack 634 is disposed on the shift rod 633. A pinion 635 is disposed on a shaft of a shift motor 636, and the pinion 635 is meshed with the rack 634.

According to the embodiment, when the sheet S is transported in a skewed state, as shown in FIG. 21, a side portion of the sheet S crosses one or both of the position sensors 601, 602. Then, the corresponding shift transportation roll 611 or 612 is laterally shifted while transporting the sheet, thereby correcting the skewed state of the sheet S.

The sheet regulation position m due to the position sensors 601, 602 is adjusted by adjusting the position of the sensor S support member 605 by the first adjusting mechanism 350, and by further adjusting the position of the unit base 342 of the transportation unit 340 by the second adjusting mechanism 370.

As described above, according to the sheet transporting apparatus of the invention, the first and second adjusting mechanisms are disposed for the side position regulating mechanism. When the two adjusting mechanisms are efficiently combined with each other, therefore, the sheet regulation position in the side position regulating mechanism can be adjusted easily and correctly.

In the invention, when a controlling device for controlling each of the adjusting mechanisms is disposed, the adjusting mechanisms can be efficiently controlled in accordance with, for example, a sheet usage condition. Therefore, the adjustment of the sheet regulation position can be optimized.

In a sheet processing apparatus using a sheet transporting apparatus of this kind, the property of transporting a sheet can be stabilized, and hence a process failure due to a skew of a sheet can be surely avoided.

According to another mode of the invention, the transportation posture of a sheet by a sheet aligning mechanism can be aligned in accordance with the deformation degree of the sheet. Therefore, a change in the sheet transportation posture caused by a cutting error of a sheet or the like can be surely adjusted.

What is claimed is:

1. A sheet transporting apparatus, comprising:

a sheet transportation path;

a predetermined number of transport members disposed in the sheet transportation path;

a side position regulating mechanism which regulates a position of a side edge of a sheet in the sheet transportation path, the side position regulating mechanism having a side guide configured to change a sheet regulation position;

a base member, rotatably mounted on a base swing fulcrum, on which at least the side guide is mounted;

a first adjusting mechanism which adjusts a position of the side guide; and a second adjusting mechanism which adjusts a position of the base member;

wherein the side position regulating mechanism includes the side guide disposed on a side of the sheet transportation path to align the side edge position of the sheet, and a skew member which skew-transports the sheet toward the side guide.

2. The sheet transporting apparatus according to claim 1, wherein the first adjusting mechanism or the second adjusting mechanism can adjust the sheet regulation position of the side position regulating mechanism, in one or both of manual and automatic manners.

3. The sheet transporting apparatus according to claim 1, wherein one of the first adjusting mechanism and the second adjusting mechanism can perform the adjustment by a course adjustment step and the other adjusting mechanism a fine adjustment step.

4. The sheet transporting apparatus according to claim 3, wherein, among the first adjusting mechanism and the second adjusting mechanism, an operation for the fine adjustment step is linked with an operation for the coarse adjustment step.

5. The sheet transporting apparatus according to claim 3, wherein the sheet position regulation by the side position regulating mechanism is performed while combinedly using the first adjusting mechanism and the second adjusting mechanism.

6. The sheet transporting apparatus according to claim 1, wherein the first adjusting mechanism supports the side guide swingably around a first swing fulcrum with respect to the base member.

7. The sheet transporting apparatus according to claim 6, wherein the second adjusting mechanism supports the base member swingably around the base swing fulcrum.

8. The sheet transporting apparatus according to claim 1, wherein the first adjusting mechanism includes a drive source and a driving transmitting mechanism; and the drive source is coupled to the side guide via the driving transmitting mechanism.

9. The sheet transporting apparatus according to claim 1, wherein the second adjusting mechanism includes a drive source and a driving transmitting mechanism; and the drive source is coupled to the base member via the driving transmitting mechanism.

10. The sheet transporting apparatus according to claim 1, further comprising: a controlling device which controls the first adjusting mechanism and the second adjusting mechanism.

11. The sheet transporting apparatus according to claim 10, wherein, in accordance with usage conditions of the sheet, the controlling device adjusts at least one of the first adjusting mechanism and the second adjusting mechanism.

12. The sheet transporting apparatus according to claim 11, wherein a direction of a sheet transportation face is used as the sheet usage condition.

13. The sheet transporting apparatus according to claim 8, wherein the driving transmitting mechanism includes a plurality of bevel gears connected to a drive transmission shaft oriented perpendicular to a shaft of the drive source, an eccentric cam is positioned on the drive transmission shaft and butts a cam follower to convert rotational movement of the eccentric cam and cam follower into a swingable movement of the side guide around a first swing fulcrum with respect to the base member.

14. The sheet transporting apparatus according to claim 9, wherein the driving transmitting mechanism includes a plurality of gears connected to a drive transmission shaft oriented parallel to a shaft of the drive source, an eccentric cam positioned on the drive transmission shaft abuts a cam follower positioned on an engagement pin and converts rotational movement of the eccentric cam and cam follower into a swingable movement of the base member around the base swing fulcrum.

15. A sheet processing apparatus, comprising:

a sheet transportation path;

a sheet processing section disposed in the sheet transportation path;

a predetermined number of transport members disposed in the sheet transportation path;

a side position regulating mechanism which regulates a position of a side edge of a sheet in the sheet transportation path, the side position regulating mechanism having a side guide configured to change a sheet regulation position;

a base member, rotatably mounted on a base swing fulcrum, on which at least the side guide is mounted;

a first adjusting mechanism which adjusts a position of the side guide; and a second adjusting mechanism which adjusts a position of the base member;

wherein the side position regulating mechanism includes the side guide disposed on a side of the sheet transportation path to align the side edge position of the sheet, and a skew member which skew-transports the sheet toward the side guide.

* * * * *